US009127241B2

(12) United States Patent
Hodge et al.

(10) Patent No.: US 9,127,241 B2
(45) Date of Patent: Sep. 8, 2015

(54) DEVELOPMENT OF EXTENSIONAL VISCOSITY FOR REDUCED ATOMIZATION FOR DILUTED CONCENTRATE SPRAYER APPLICATIONS

(71) Applicants: Charles A. Hodge, Cottage Grove, MN (US); Christopher M. McGuirk, Menasha, WI (US); Mark D. Levitt, West. St. Paul, MN (US); Dale Larson, Eagan, MN (US); Elizabeth R. Kiesel, St. Paul, MN (US); Amanda R. Blattner, Prior Lake, MN (US)

(72) Inventors: Charles A. Hodge, Cottage Grove, MN (US); Christopher M. McGuirk, Menasha, WI (US); Mark D. Levitt, West. St. Paul, MN (US); Dale Larson, Eagan, MN (US); Elizabeth R. Kiesel, St. Paul, MN (US); Amanda R. Blattner, Prior Lake, MN (US)

(73) Assignee: ECOLAB USA INC., St. Paul, MN (US)

( * ) Notice: Subject to any disclaimer, the term of this patent is extended or adjusted under 35 U.S.C. 154(b) by 213 days.

(21) Appl. No.: 13/622,649

(22) Filed: Sep. 19, 2012

(65) Prior Publication Data

US 2013/0255729 A1 Oct. 3, 2013

Related U.S. Application Data

(60) Provisional application No. 61/537,390, filed on Sep. 21, 2011.

(51) Int. Cl.

| | |
|---|---|
| ***C11D 17/00*** | (2006.01) |
| ***C11D 1/04*** | (2006.01) |
| ***C11D 3/20*** | (2006.01) |
| ***C11D 3/37*** | (2006.01) |
| ***B08B 3/02*** | (2006.01) |

(52) U.S. Cl.

CPC ..... *C11D 17/0026* (2013.01); *B08B 3/02* (2013.01); *C11D 1/04* (2013.01); *C11D 3/2079* (2013.01); *C11D 3/3707* (2013.01); *C11D 3/3765* (2013.01); *C11D 3/3773* (2013.01); *C11D 17/0043* (2013.01)

(58) Field of Classification Search

CPC ..... C11D 17/041; C11D 3/3757; C11D 1/72; C11D 17/0043; C11D 17/0026

USPC ..... 510/475, 477, 198

See application file for complete search history.

(56) References Cited

U.S. PATENT DOCUMENTS

| | | | | |
|---|---|---|---|---|
| 4,510,081 | A | 4/1985 | Bronner et al. | |
| 4,823,268 | A | 4/1989 | Giles et al. | |
| 4,935,224 | A | 6/1990 | Russo et al. | |
| 5,134,961 | A | 8/1992 | Giles et al. | |
| 5,364,551 | A * | 11/1994 | Lentsch et al. | 510/100 |
| 5,442,552 | A | 8/1995 | Slaughter et al. | |
| 5,462,689 | A | 10/1995 | Choy et al. | |
| 5,544,813 | A | 8/1996 | Giles et al. | |

(Continued)

FOREIGN PATENT DOCUMENTS

| | | | |
|---|---|---|---|
| EP | 0787778 | A1 | 8/1997 |
| GB | 2 306 965 | A | 5/1997 |
| WO | WO2011/036053 | A1 | 3/2011 |

OTHER PUBLICATIONS

Dexter, R.W., "*Measurement of Extensional Viscosity of Polymer Solutions and Its Effects on Atomization from a Spray Nozzle*", Atomization and Sprays, vol. 6, 167-191, 1996.

(Continued)

*Primary Examiner* — Gregory Webb

(74) *Attorney, Agent, or Firm* — Eric E. DeMaster

(57) ABSTRACT

A non-Newtonian concentrate composition includes a sensitizer or irritant, a surfactant, an anti-mist component and optionally a stability component. Example sensitizers and irritants include, but are not limited to, acids, quaternary compounds, and amines, and example anti-mist components include, but are not limited to, polyethylene oxide and polyacrylamide.

38 Claims, 3 Drawing Sheets

(56) References Cited

U.S. PATENT DOCUMENTS

| | | | | |
|---|---|---|---|---|
| 5,653,389 | A | 8/1997 | Henderson et al. | |
| 5,704,546 | A | 1/1998 | Henderson et al. | |
| 5,948,741 | A * | 9/1999 | Ochomogo et al. | 510/191 |
| 5,967,066 | A | 10/1999 | Giles et al. | |
| 6,372,842 | B1 | 4/2002 | Grisso et al. | |
| 6,491,840 | B1 * | 12/2002 | Frankenbach et al. | 252/8.91 |
| 7,278,294 | B2 | 10/2007 | Giles et al. | |
| 7,311,004 | B2 | 12/2007 | Giles | |
| 7,502,665 | B2 | 3/2009 | Giles et al. | |
| 7,566,448 | B2 | 7/2009 | Becker | |
| 7,665,348 | B2 | 2/2010 | Giles | |
| 7,742,842 | B2 | 6/2010 | Giles et al. | |
| 2006/0089443 | A1 | 4/2006 | Roa-Espinosa | |
| 2006/0225489 | A1 | 10/2006 | Giles et al. | |
| 2006/0265106 | A1 | 11/2006 | Giles et al. | |
| 2008/0114497 | A1 | 5/2008 | Giles et al. | |
| 2008/0114498 | A1 | 5/2008 | Giles et al. | |
| 2008/0230624 | A1 | 9/2008 | Giles et al. | |
| 2008/0307893 | A1 | 12/2008 | Giles | |
| 2009/0134237 | A1 | 5/2009 | Giles | |
| 2010/0132439 | A1 | 6/2010 | Giles | |
| 2010/0286019 | A1 | 11/2010 | Scher et al. | |

OTHER PUBLICATIONS

Giles, D. K. et al, "*Suppression of Aerosol Generation During Spraying and Deposition of Consumer Products*", Atomization and Sprays, vol. 15, 423-438, 2005.

Giles, D. K. et al. "*Flow Control and Spray Cloud Dynamics from Hydraulic Atomizers*", Transactions of the ASAE, vol. 45(3): 539-546.

Giles, D. K. et al. "*Independent Control of Liquid Flow Rate and Spray Droplet Size from Hydraulic Atomizers*", Atomization and Sprays, vol. 7, 161-181, 1997.

Extended European Search Report for European Application No./ Patent No. 14168793.9-1357, mailed Sep. 4, 2014.

Extended European Search Report for European Application No./ Patent No. 114168790.5-1357/2784142, mailed Nov. 4, 2014.

International Preliminary Report on Patentability PCT/US2012/ 056078, report issued Mar. 25, 2014.

Giles, D. K. et al. "Flow Control and Spray Cloud Dynamics from Hydraulic Atomizers", Transactions of the ASAE, vol. 45(3): 539-546, 2002.

Giles, D. K. et al. "Precision Band Spraying with Machine-Vision Guidance and Adjustable Yaqw Nozzles", Transactions of the ASAE, vol. 40(1): 29-36, 1997.

Giles, D.K. et al. "Transient Droplet Size Spectra from Trigger Sprayers Dispensing Aqueous Solutions", Transactions of the ASAE, vol. 48(1): 63-72, 2005.

Growe, T.G. et al. "Digital Device and Technique for Sensing Distribution of Spray Deposition", Transactions of the ASAE, vol. 48(6): 2085-2093, 2005.

* cited by examiner

DEVELOPMENT OF EXTENSIONAL VISCOSITY FOR REDUCED ATOMIZATION FOR DILUTED CONCENTRATE SPRAYER APPLICATIONS

CROSS-REFERENCE TO RELATED APPLICATION

This application claims the benefit under 35 U.S.C §119 of U.S. Provisional Application No. 61/537,390, filed on Sep. 21, 2011, entitled "Development of Extensional Viscosity for Reduced Atomization for Diluted Concentrate Sprayer Applications" which is herein incorporated by reference in its entirety.

TECHNICAL FIELD

The present invention is related to the field of sprayable aqueous compositions. In particular, the present invention is related to sprayable aqueous compositions including an anti-mist component for controlling droplet size.

BACKGROUND

Aqueous sprayable compositions can be applied to a hard surface with a transient trigger spray device or an aerosol spray device. These cleaners have great utility because they can be applied by spray to vertical, overhead or inclined surfaces. Spray devices create a spray pattern of the aqueous sprayable compositions that contacts the target hard surfaces. The majority of the sprayable composition comes to reside on the target hard surfaces as large sprayed-on deposits, while a small portion of the sprayable composition may become an airborn aerosol or mist, which consists of small particles comprising the cleaning composition that can remain suspended or dispersed in the atmosphere surrounding the dispersal site for a period of time, such as between about 5 seconds to about 10 minutes.

The aqueous sprayable compositions may be supplied as concentrated solutions which may be diluted with water to form use solutions. Such concentrated solutions reduce transportation and storage costs since the dilution water is not transported or stored but instead is added to the solution at a later time. In some embodiments, it is preferable that the concentrate is stable at elevated temperatures and low temperatures, such as those experienced during transportation and storage.

SUMMARY

In one embodiment, a non-Newtonian concentrate composition includes at least one acid, at least one surfactant and an anti-mist component. The anti-mist component is selected from polyethylene oxide, polyacrylamide, polyacrylate and combinations thereof. The non-Newtonian composition has a viscosity of less than about 40 centipoise.

In another embodiment, the non-Newtonian concentrate composition includes water, at least one surfactant and an anti-mist component. A further embodiment is a method of using a concentrate cleaning solution. The concentrate cleaning solution includes a surfactant and an anti-mist component and is diluted with water to form a use solution having an anti-mist component concentration between about 0.002% and about 0.006% by weight, where the anti-mist component is selected from polyethylene oxide, polyacrylamide, and combinations thereof.

A still further embodiment is a method of using a concentrate cleaning solution where the concentrate solution is diluted with water to form a use solution having a polyacrylate concentration between about 0.2% and 5% by weight.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

DETAILED DESCRIPTION

Figure 1:
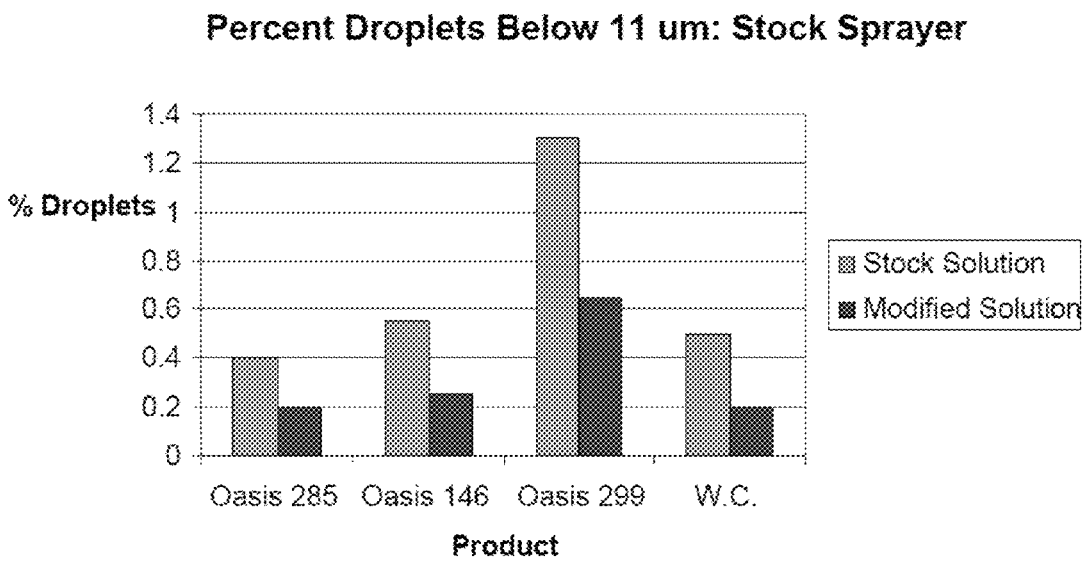
FIG. 1 illustrates the percentage of droplets below 11 microns for stock ready to use sprayable solutions and ready to use sprayable solutions modified with polyethylene oxide when applied with a stock trigger sprayer (i.e., non-low viscosity sprayer).

The present invention relates to concentrate sprayable compositions including an anti-mist component, such as polyethylene oxide, polyacrylamide, or polyacrylate, and use solutions thereof. In one embodiment, the concentrate sprayable compositions may contain a sufficient amount of anti-mist component such that when the concentrate is diluted with water to form a use solution and is dispensed from a transient trigger sprayer, the use solution exhibits an increased median droplet size and reduced mist or aerosol. In one embodiment, the sprayable use solution produces little or no small particle aerosol. In another embodiment, when dispensed with a trigger sprayer, the sprayable use solution has a median droplet size above 50 microns. It has been found that increasing the droplet size of the dispensed use solution can reduce inhalation and aerosol and misting.

The sprayable compositions can be used in any environment where it is desirable to have larger droplet sizes dispensed from a transient trigger sprayer. For example, the sprayable composition can be used in institutional applications, food and beverage applications, heath care applications, vehicle care applications, pest elimination applications, and laundering applications. Such applications include but are not limited to laundry and textile cleaning and destaining, kitchen and bathroom cleaning and destaining, carpet cleaning and destaining, vehicle cleaning and destaining, cleaning in place operations, general purpose cleaning and destaining, surface cleaning and destaining, particularly hard surfaces, glass window cleaning, air freshening or fragrancing, industrial or household cleaners, antimicrobial cleaning. Methods of using the sprayable compositions are also provided.

The concentrate sprayable composition includes at least one anti-mist component, such as polyethylene oxide (PEO), polyacrylamide or polyacrylate. The anti-mist component may function to reduce atomization and misting of the sprayable solution when dispensed using a sprayer, including aerosol sprayers and transient trigger sprayers. Example transient trigger sprayers include stock transient trigger sprayers (i.e., non-low velocity trigger sprayer) and low-velocity trigger sprayers, both available from Calmar. Suitable commercially available stock transient trigger sprayers include Calmar Mixor HP 1.66 output trigger sprayer. The anti-mist component may also increase the median particle size of the dispensed use solution, which reduces inhalation of the use solution, and particularly reduces inhalation of the sensitizer or irritant.

In one example, the concentrate sprayable composition includes polyethylene oxide (PEO), polyacrylamide or polyacrylate. In another example, the concentrate sprayable composition includes mixtures of polyethylene oxide (PEO), polyacrylamide and polyacrylate. In a further example, the concentrate sprayable composition includes mixtures of polyethylene oxide (PEO) and polyacrylamide. PEO is a high molecular weight polymer. A suitable PEO can have a molecular weight between about 3,000,000 and about 7,000,000. One commercially available PEO is Polyox WSR 301, which has a molecular weight of about 4,000,000 and is available from Dow. A suitable concentration range for PEO is between approximately 0.01% and 0.3% by weight of the concentrate sprayable solution. A particularly suitable concentration range for PEO is between approximately 0.01% and 0.2% by weight of the concentrate sprayable solution.

The anti-mist component may alternatively or additionally include a polyacrylamide A suitable polyacrylamide can have a molecular weight between about 8 million and about 16 million, and more suitably between about 11 million and about 13 million. One commercially available polyacrylamide is SuperFloc® N-300 available from Kemira Water Solutions, Inc. A suitable concentration range for polyacrylamide is between approximately 0.01% and 0.3% by weight of the concentrate sprayable solution. A particularly suitable concentration range for polyacrylamide is between approximately 0.01% and 0.2% by weight of the concentrate sprayable solution.

Polyacrylate is a high molecular weight polymer. A suitable polyacrylate polymer can have a molecular weight between about 500,000 and about 3 million. A more suitable polyacrylate polymer can have a molecular weight of at least about 1 million. One commercially available polyacrylate is Aquatreat® AR-7H available from Akzo Nobel. Suitable polyacrylate concentrations in the concentrate composition are between about 0.5% and about 20% by weight. Particularly suitable polyacrylate concentrations in the concentrate composition are between about 1% and about 10% by weight.

The concentrate sprayable compositions may optionally include at least one stability component. The effectiveness of an anti-mist component to reduce misting and increase droplet size may degrade over time. A stability component may reduce degradation of the anti-mist component and improve the self-life of the concentrate sprayable composition. Suitable stability components may include antioxidants, chelants, and solvents. Example antioxidants include, but are not limited to, Irganox® 5057, a liquid aromatic amine antioxidant, Irganox® 1135, a liquid hindered phenolic antioxidant, Tinogard NOA, and Irgafos 168, all available from BASF. Additional example antioxidants include vitamin E acetate. Example chelants include, but are not limited to: sodium gluconate, sodium glucoheptonate, N-hydroxyethylenediaminetriacetic acid (HEDTA), ethylenediaminetetraacetic acid (EDTA), nitrilotriacetic acid (NTA), diethylenetriaminepentaacetic acid (DTPA), ethylenediaminetetraproprionic acid, triethylenetetraaminehexaacetic acid (TTHA), and the respective alkali metal, ammonium and substituted ammonium salts thereof, ethylenediaminetetraacetic acid tetrasodium salt (EDTA), nitrilotriacetic acid trisodium salt (NTA), ethanoldiglycine disodium salt (EDG), diethanolglycine sodium-salt (DEG), and 1,3-propylenediaminetetraacetic acid (PDTA), dicarboxymethyl glutamic acid tetrasodium salt (GLDA), methylglycine-N—N-diacetic acid trisodium salt (MGDA), and iminodisuccinate sodium salt (IDS). Suitable commercially available chelant include Dissolvine® GL-47-S, tetrasodium glutamate diacetate, and Dissolvine® GL-38, glutamic acid, N,N-diacetic acid, tetra sodium salt, both available from Akzo Nobel. Example solvents include, but are not limited to, propylene glycol and glycerine. A suitable concentration range of the stability components includes between approximately 100 parts per million (ppm) and approximately 100,000 ppm of the concentrate sprayable composition or between approximately 0.01% and 10% by weight. A particularly suitable concentration range of the stability components includes between approximately 100 parts per million (ppm) and approximately 70,000 ppm of the concentrate sprayable composition or between approximately 0.01% and 7% by weight.

The concentrate sprayable compositions may include a combination of stability components, which may further improve the stability of the composition. For example, the concentrate sprayable compositions may include a combination of two or more antioxidants, chelants and solvents. In one example, the concentrate sprayable composition may include an antioxidant and a chelant. In a further example the concentrate sprayable composition may include Irganox® 1135 and Dissolvine® GL-47-S. It has been found that when used in combination the effective amounts of Irganox® 1135 and Dissolvine® GL-47-S are half the effective amounts of each when used alone.

The concentrate sprayable composition is a non-Newtonian fluid. Newtonian fluids have a short relaxation time and have a direct correlation between shear and elongational viscosity (the elongational viscosity of the fluid equals three times the shear viscosity). Shear viscosity is a measure of a fluid's ability to resist the movement of layers relative to each other. Elongational viscosity, which is also known as extensional viscosity, is measure of a fluid's ability to stretch elastically under elongational stress. Non-Newtonian fluids do not have a direct correlation between shear and elongational viscosity and are able to store elastic energy when under strain, giving exponentially more elongational than shear viscosity and producing an effect of thickening under strain (i.e., shear thickening). These properties of non-Newtonian fluids result in the sprayable composition that has a low viscosity when not under shear but that thickens when under stress from the trigger sprayer forming larger droplets.

The concentrate sprayable composition has a relatively low shear viscosity when not under strain. The shear viscosity can be measured with a Brookfield LVDV-II viscometer using spindle R1, at 50 rpm and room temperature. As described further below, in one example, the shear viscosity of the concentrate sprayable composition is comparable to the shear viscosity of water. A suitable shear viscosity for the concentrate sprayable composition is about 40 centipoises or less. A more preferable shear viscosity is about 30 centipoises or less. In one example, the anti-mist components do not increase the shear viscosity of the concentrate sprayable composition when not under strain and the increased shear viscosity is created by other components, such as the surfactant. In comparison to the low shear viscosity concentrate sprayable composition of the current application, adding xanthan gum to a concentrate produces a Newtonian fluid which is too thick to be used as a concentrate. The concentrate sprayable composition of the current application forms a low shear viscosity, water thin, mixture even at high concentrations of the anti-mist component, such as those required for concentrate solutions.

In another example, a flowable concentrate sprayable composition contains a sufficient amount of anti-mist component such that the median particle size of the dispensed use solution is sufficiently large enough to reduce misting. A suitable median particle size is about 11 microns or greater. A particularly suitable median particle size is about 50 microns or greater. A more particularly suitable median particle size is about 70 microns or greater, about 100 microns or greater, about 150 microns or greater, or about 200 microns or greater. The suitable median particle size may depend on the composition of the use solution, and thus of the concentrate sprayable composition. For example, a suitable median particle size for a strongly acidic or alkaline use solution may be about 100 microns or greater, and more particularly about 150 microns or greater, and more particularly about 200 microns or greater. A suitable median particle size for a moderately acidic or alkaline use solution may be about 11 microns or greater, preferably about 50 microns or greater, and more preferably about 150 microns or greater. A strongly acid use solution may have a pH of about 3 or below, a strongly alkaline use solution may have a pH of about 11 or greater, and a moderately acidic or alkaline use solution may have a pH between about 3 and about 11.

In one example, the concentrate sprayable compositions are concentrate acidic sprayable non-Newtonian compositions that generally include at least one acid, at least one surfactant, and at least one anti-mist component, such as polyethylene oxide (PEO) or polyacrylamide (PAA). A suitable concentration range of the components of the concentrate sprayable composition includes between approximately between approximately 0.1% and 30% by weight surfactant, between approximately 0.1% and 75% by weight of at least one acid, and between approximately 0.01% and 0.3% PEO or PAA. The concentrate sprayable compositions can be diluted with water to form ready to use solutions.

In another example, the concentrate sprayable compositions generally include at least one acid, at least one surfactant, and polyacrylate. A suitable concentration range of the components of the concentrate sprayable composition includes between approximately between approximately 0.1% and 30% by weight surfactant, between approximately 7% and 75% by weight of at least one acid, and between approximately 0.5% and 20% polyacrylate. The concentrate sprayable compositions can be diluted with water to form ready to use solutions.

The acid can be a strong acid which substantially dissociates in an aqueous solution such as, but not limited to hydrobromic acid, hydroiodic acid, hydrochloric acid, perchloric acid, sulfuric acid, trichloroacetic acid, trifluoroacetic acid, nitric acid, dilute sulfonic acid, and methanesulfonic acid. Weak organic or inorganic acids can also be used. Weak acids are acids in which the first dissociation step of a proton from the acid cation moiety does not proceed essentially to completion when the acid is dissolved in water at ambient temperatures at a concentration within the range useful to form the present sprayable composition. Such inorganic acids are also referred to as weak electrolytes. Examples of weak organic and inorganic acids include phosphoric acid, sulfamic acid, acetic acid, hydroxy acetic acid, citric acid, benzoic acid, tartaric acid, maleic acid, malic acid, fumaric acid, lactic acid, succinic acid, gluconic acid, glucaric acid, and the like. Mixtures of strong acid with weak acid or mixtures of a weak organic acid and a weak inorganic acid with a strong acid may also be used.

The acid can be present in sufficient quantities such that the concentrate sprayable composition has an acidic pH. In one example, the concentrate sprayable composition has a pH of 4.5 or lower. In another example, the concentrate sprayable composition includes between approximately 7% and 75% by weight acid. In a further example, the concentrate sprayable composition includes between approximately 10% and approximately 65% by weight acid. In a still further example, the concentrate sprayable composition includes between approximately 40% and 60% by weight acid. Highly acidic concentrate sprayable compositions, particularly those including between approximately 40% and 60% by weight acid, containing at least one anti-mist component have demonstrated instability when stored at elevated temperatures for extended periods of time. The stability component may improve the shelf-life of the concentrate sprayable compositions.

The acid can also include a fatty acid, such as a fatty acid antimicrobial agent or neutralized salt of a fatty acid. Suitable fatty acids include medium chain fatty acids, including $C_6$-$C_{16}$ alkyl carboxylic acids, such as hexanoic acid, butyric acid, octanoic acid, heptanoic acid, nonanoic acid, decanoic acid, undecanoic acid, and dodecanoic acid. More suitable fatty acids include a $C_8$-$C_{12}$ alkyl carboxylic acid, still more suitably $C_9$-$C_{10}$ alkyl carboxylic acid, such as decanoic acid (capric acid). In one example, the sprayable composition includes at least one fatty acid and has a total acid concentration of between about 7% and 45% by weight. In a further example, the fatty acid comprises between about 1% and 10% by weight with a total acid concentration between about 7% and 45% by weight.

The concentrate sprayable composition includes a surfactant. A variety of surfactants may be used, including anionic, nonionic, cationic, and amphoteric surfactants. Example suitable anionic materials are surfactants containing a large lipophilic moiety and a strong anionic group. Such anionic surfactants contain typically anionic groups selected from the group consisting of sulfonic, sulfuric or phosphoric, phosphonic or carboxylic acid groups which when neutralized will yield sulfonate, sulfate, phosphonate, or carboxylate with a cation thereof preferably being selected from the group consisting of an alkali metal, ammonium, alkanol amine such as sodium, ammonium or triethanol amine. Examples of operative anionic sulfonate or sulfate surfactants include alkylbenzene sulfonates, sodium xylene sulfonates, sodium dodecylbenzene sulfonates, sodium linear tridecylbenzene sulfonates, potassium octyldecylbenzene sulfonates, sodium lauryl sulfate, sodium palmityl sulfate, sodium cocoalkyl sulfate, sodium olefin sulfonate.

Nonionic surfactants carry no discrete charge when dissolved in aqueous media. Hydrophilicity of the nonionic is provided by hydrogen bonding with water molecules. Such nonionic surfactants typically comprise molecules containing large segments of a polyoxyethylene group in conjunction with a hydrophobic moiety or a compound comprising a polyoxypropylene and polyoxyethylene segment. Polyoxyethylene surfactants are commonly manufactured through base catalyzed ethoxylation of aliphatic alcohols, alkyl phenols and fatty acids. Polyoxyethylene block copolymers typically comprise molecules having large segments of ethylene oxide coupled with large segments of propylene oxide. These nonionic surfactants are well known for use in this art area. Additional example nonionic surfactants include alkyl polyglycosides.

The lipophilic moieties and cationic groups comprising amino or quaternary nitrogen groups can also provide surfactant properties to molecules. As the name implies to cationic surfactants, the hydrophilic moiety of the nitrogen bears a positive charge when dissolved in aqueous media. The soluble surfactant molecule can have its solubility or other surfactant properties enhanced using low molecular weight alkyl groups or hydroxy alkyl groups.

The cleaning composition can contain a cationic surfactant component that includes a detersive amount of cationic surfactant or a mixture of cationic surfactants. The cationic surfactant can be used to provide sanitizing properties. In one example, cationic surfactants can be used in either acidic or basic compositions.

Cationic surfactants that can be used in the cleaning composition include, but are not limited to: amines such as primary, secondary and tertiary monoamines with $C_{18}$ alkyl or alkenyl chains, ethoxylated alkylamines, alkoxylates of ethylenediamine, imidazoles such as a 1-(2-hydroxyethyl)-2-imidazoline, a 2-alkyl-1-(2-hydroxyethyl)-2-imidazoline, and the like; and quaternary ammonium compounds and salts, as for example, alkylquaternary ammonium chloride surfactants such as n-alkyl($C_{12}$-$C_{18}$)dimethylbenzyl ammonium chloride, n-tetradecyldimethylbenzylammonium chloride monohydrate, a naphthylene-substituted quaternary ammonium chloride such as dimethyl-1-naphthylmethylammonium chloride.

Amphoteric surfactants can also be used. Amphoteric surfactants contain both an acidic and a basic hydrophilic moiety in the structure. These ionic functions may be any of the anionic or cationic groups that have just been described previously in the sections relating to anionic or cationic surfactants. Briefly, anionic groups include carboxylate, sulfate, sulfonate, phosphonate, etc. while the cationic groups typically comprise compounds having amine nitrogens. Many amphoteric surfactants also contain ether oxides or hydroxyl groups that strengthen their hydrophilic tendency. Preferred amphoteric surfactants of this invention comprise surfactants that have a cationic amino group combined with an anionic carboxylate or sulfonate group. Examples of useful amphoteric surfactants include the sulfobetaines, N-coco-3,3-aminopropionic acid and its sodium salt, n-tallow-3-amino-dipropionate disodium salt, 1,1-bis(carboxymethyl)-2-undecyl-2-imidazolinium hydroxide disodium salt, cocoaminobutyric acid, cocoaminopropionic acid, cocoamidocarboxy glycinate, cocobetaine. Suitable amphoteric surfactants include cocoamidopropylbetaine and cocoaminoethylbetaine.

Amine oxides, such as tertiary amine oxides, may also be used as surfactants. Tertiary amine oxide surfactants typically comprise three alkyl groups attached to an amine oxide (N→O). Commonly the alkyl groups comprise two lower ($C_{1-4}$) alkyl groups combined with one higher $C_{6-24}$ alkyl groups, or can comprise two higher alkyl groups combined with one lower alkyl group. Further, the lower alkyl groups can comprise alkyl groups substituted with hydrophilic moiety such as hydroxyl, amine groups, carboxylic groups, etc. Suitable amine oxide materials include dimethylcetylamine oxide, dimethyllaurylamine oxide, dimethylmyristylamine oxide, dimethylstearylamine oxide, dimethylcocoamine oxide, dimethyldecylamine oxide, and mixtures thereof. The classification of amine oxide materials may depend on the pH of the solution. On the acid side, amine oxide materials protonate and can simulate cationic surfactant characteristics. At neutral pH, amine oxide materials are non-ionic surfactants and on the alkaline side, they exhibit anionic characteristics.

The concentrate acidic sprayable compositions may include water. Suitable concentrations of water include between about 25% and 90% by weight. More suitable concentrations of water include between about 45% and about 70% by weight and between about 25% and about 45% by weight.

In another embodiment, the concentrate sprayable composition is a concentrate quaternary sprayable composition that generally includes water, a quaternary compound, at least one of PEO, PAA, and polyacrylate, and optionally may include a stability component. The pH of the concentrate quaternary sprayable composition can be between about 4 and about 12. Suitable quaternary compounds include quaternary ammonium compounds. When the concentrate quaternary sprayable composition includes PEO or PAA, suitable concentrations include between about 75% and 95% by weight water, between about 5% and 30% by weight quaternary compounds, less than about 1% of at least one fragrance or dye, between about 0.01% and 0.3% by weight of at least one of PEO or PAA and optionally between about 0.01% and 10% by weight of a stability component. In another example, the concentrate quaternary sprayable composition includes between about 10% and about 20% by weight quaternary compounds. In a further example, the concentrate quaternary sprayable composition consists essentially of between about 75% and 95% by weight water, between about 5% and 30% by weight quaternary compounds, less than about 1% of at least one fragrance or dye, between about 0.01% and 0.3% by weight of at least one of PEO or PAA and optionally between about 0.01% and 10% by weight of a stability component.

When the concentrate quaternary sprayable composition includes polyacrylate, suitable concentrations include between about 75% and 95% by weight water, between about 5% and 30% by weight quaternary compounds, less than about 1% of at least one fragrance or dye, between about 0.5% and 20% by weight of polyacrylate and optionally between about 0.01% and 10% by weight of a stability component. In a further example, the concentrate quaternary sprayable composition consists essentially of between about 75% and 95% by weight water, between about 5% and 30% by weight quaternary compounds, less than about 1% of at least one fragrance dye, between about 0.5% and 20% by weight of polyacrylate and optionally between about 0.01% and 10% by weight of a stability component.

In a further embodiment, the concentrate sprayable composition is a concentrate sprayable air freshener composition. In one example, the concentrate sprayable air freshener composition includes water, at least one nonionic surfactant, at least one anionic surfactant, at least one of PEO, PAA, and polyacrylate, at least one fragrance or dye, and optionally may include a stability component and/or a microbiocide. Suitable concentrations when the anti-mist component is PEO or PAA include between about 50% and 90% by weight water, between about 1% and 15% by weight nonionic surfactant, between about 1% and 10% by weight anionic surfactant, between about 0.01% and 0.3% by weight of at least one of PEO and PAA, between about 0.05% and 15% by weight of at least one fragrance or dye, and optionally may include between about 0.01% and 10% by weight of at least one stability component. Suitable concentrations when the anti-mist component is polyacrylate include between about 50% and 90% by weight water, between about 1% and 15% by weight nonionic surfactant, between about 1% and 10% by weight anionic surfactant, between about 0.5% and about 20% by weight polyacrylate, between about 0.05% and 15% by weight of at least one fragrance or dye, and optionally may include between about 0.01% and 10% by weight of at least one stability component. The concentrate sprayable air freshener composition may include between about 0% and about 0.1% by weight of a microbiocide, and more preferably may include between about 0.03% and about 0.1% by weight of microbiocide. In a further example, the sprayable compositions consist essentially of the components listed above.

In a still further embodiment, the sprayable composition is a concentrate sprayable window glass cleaning composition. The concentrate sprayable window glass cleaning composition may include water, a solvent, a surfactant, optionally at least one fragrance or dye, at least one of PEO, PAA and polyacrylate and optionally at least one stability component. The concentrate sprayable window glass cleaning composition can have a pH of between about 2 and about 11.5. Suitable solvents include ethanol and 1,3-propanediol, both VOC solvents. "VOC" refers to volatile organic compounds, which have been the subject of regulation by different government entities, the most prominent regulations having been established by the California Air Resource Board in its General Consumer Products Regulation. A compound is non-volatile if its vapor pressure is below 0.1 mm Hg at 20° C.

In one embodiment, suitable compositions comprise between about 65% and 98% by weight water, between about 0.05% and 15% by weight solvent (such as a VOC solvent or a non-VOC solvent), between about 0.01% and about 10% by weight surfactant, between about 0.01% and about 0.3% by weight of PEO, PAA or a combination thereof, and optionally between about 0.01% and 10% by weight of at least one stability component. Suitable compositions may alternatively comprise between about 85% and 95% by weight water, between about 0.5% and 10% by weight solvent, between about 0.05% and about 10% by weight surfactant, between about 0.01% and about 0.3% by weight of PEO, PAA or a combination thereof, and optionally between about 0.01% and 10% by weight of at least one stability component. Fragrances and/or dyes may be present in amount of between about 0% and about 0.7% by weight of the concentrate composition. The antimist component of the suitable compositions described above may also include between about 0.01% and 10% by weight of at least one stability component.

In an alternative embodiment, the concentrate sprayable window glass cleaning composition has a low concentration of VOCs and/or a relatively high concentration of biobased content. In one example, the concentrate sprayable window glass cleaning composition comprises water, at least one solvent or glycerine, at least one surfactant, optionally at least one fragrance or dye, optionally at least one chelant, optionally at least one dispersant, at least one of PEO, PAA and polyacrylate, and optionally at least one stability component.

Suitable surfactants include alkyl polyglycosides. Suitable alkyl polyglycosides include but are not limited to alkyl polyglucosides and alkyl polypentosides. Alkyl polyglycosides are bio-based non-ionic surfactants which have wetting and detersive properties. Commercially available alkyl polyglycosides may contain a blend of carbon lengths. Suitable alkyl polyglycosides include alkyl polyglycosides containing short chain carbons, such as chain lengths of less than $C_{12}$. In one example, suitable alkyl polyglycosides include $C_8$-$C_{10}$ alkyl polyglycosides and alkyl polyglycosides blends primarily containing $C_8$-$C_{10}$ alkyl polyglycosides. Suitable commercially available alkyl polyglucosides include Glucopon 215 UP available from BASF Corporation. Alkyl polypentosides are commercially available from Wheatoleo. Suitable commercially available polypentosides include Radia®Easysurf 6781, which contains chain lengths of about $C_8$-$C_{10}$ and is available from Wheatoleo.

Suitable solvents include propylene glycol and suitable bio-based alternatives 1,3-propanediol. Alternatively, glycerine may be used when a low VOC, high bio-based content cleaner is desired. Glycerine is a poor solvent. However, it has been found that glycerine can help a cloth "glide" across the surface of a window and reduce streaking.

The concentrate window glass cleaning composition can optionally include a sheeting agent, such as an ethylene oxide and propylene oxide block copolymer. Suitable sheeting agents include Pluronic N-3, available from BASF Corporation. In some situations, it may be desirable to exclude ethylene oxide and propylene oxide block copolymers from the concentrate window glass cleaning composition.

A dispersant may be added to the concentrate sprayable window glass cleaning composition to assist with dispersing water hardness and other non-hardness materials such as but not limited to total dissolved solids such as sodium salts. Suitable dispersants include sodium polycarboxylates, such as sodium polyacrylate, and acrylate/sulfonated co-polymers. In one example, the sodium polycarboxylate or acrylate/sulfonated co-polymer has a molecular weight less than about 100,000. In another example, the sodium polycarboxylate or acrylate/sulfonated co-polymer has a molecular weight less than about 50,000. In a further example, the sodium polycarboxylate or acrylate/sulfonated co-polymer has a molecular weight between about 5,000 and about 25,000. Suitable commercially available polymers include Acusol 460N available from Rohm and Haas and Aquatreat AR-546 available from Akzo Nobel.

Suitable chelants include amino-carboxylates such as but not limited to salts of ethylenediamine-tetraacetic acid (EDTA) and methyl glycine di-acetic acid (MGDA), and dicarboxymethyl glutamic acid tetrasodium salt (GLDA). The amino-carboxylates may also be in its acid form. Suitable commercially available MGDAs include but are not limited to Trilon® M available from BASF. Biobased amino-carboxylates, such as GLDA, may also be used. Suitable biobased amino-carboxylates may contain at least 40% bio-based content, at least 45% bio-based content, and more preferably, at least 50% bio-based content. For example, suitable commercially available GLDAs include but are not limited to Dissolvine® GL-47-S and Dissolvine® GL-38 both available from Akzo Nobel, which contain approximately 50% bio-based content.

Suitable concentrations for a concentrate sprayable window glass cleaning composition having low VOCs include between about 20% and 99.9% by weight water, between about 0% and about 5% by weight of at least one dispersant, between about 0% and about 10% by weight chelant, between about 0.05% and about 30% by weight solvent or glycerine, between about 0.05% and about 50% by weight surfactant, between about 0% and about 0.7% by weight of at least one fragrance or dye, between about 0.01% and about 0.3% by weight of PEO, PAA or a combination thereof, and optionally between about 0.01% and 10% by weight of at least one stability component. More suitable concentrations include between about 65% and 99.9% by weight water, between about 0.01% and about 5% by weight of at least one dispersant, between about 0.05% and about 5% by weight chelant, between about 0.05% and about 8% by weight solvent or glycerine, between about 0.5% and about 20% by weight surfactant, between about 0% and about 0.7% by weight of at least one fragrance or dye, between about 0.01% and about 0.3% by weight of PEO, PAA or a combination thereof, and optionally between about 0.01% and 10% by weight of at least one stability component. Even more suitable concentrations include between about 85% and 99.9% by weight water, between about 0.01% and about 5% by weight of at least one dispersant, between about 0.05% and about 2% by weight chelant, between about 0.05% and about 2% by weight solvent or glycerine, between about 1% and about 10% by weight surfactant, between about 0% and about 0.7% by weight of at least one fragrance or dye, between about 0.01% and about 0.3% by weight of PEO, PAA or a combination thereof, and optionally between about 0.01% and 10% by weight of at least one stability component. The concentrate sprayable window cleaner may further optionally include between about 0% and 0.05% by weight sheeting agent.

A suitable VOC content of the use solution includes less than about 3% VOCs by weight of the use solution, less than about 1% VOCs by weight of the use solution, or about 0% VOCs by weight of the use solution. The low VOC concentrate window glass cleaning composition may also have a relatively high biobased content. In one example, the low VOC concentrate window glass cleaning composition includes at least 49% biobased content. More suitably, the low VOC concentrate window glass cleaning composition includes at least 75%, at least 80%, at least 85%, at least 90%, or at least 95% biobased content. Suitable low VOC window glass cleaning compositions are also disclosed in the provisional application entitled "Bio-Based Glass Cleaner" Ser. No. 09/936,048 which was filed on even date and which is incorporated by reference herein.

It is recognized that the above components may be replaced partially or in total with a comparable biobased component. Biobased components are components that are composed, in whole or in significant part, of biological products. The amount of biological components or derivatives is referred to as biobased content, which is the amount of biobased carbon in the material or product expressed as a percent of weight (mass) of the total organic carbon in the material or product. Biobased content can be determined using ASTM Method D6866, entitled *Standard Test Methods for Determining the Biobased Content of Natural Range Materials Using Radiocarbon and Isotope Ratio Mass Spectometry Analysis*. More specifically, ASTM Method D6866 uses radiocarbon dating to measure the amount of new carbon present in a product as a percentage of the total organic carbon by comparing the ratio of Carbon 12 to Carbon 14. The water content of a product is not included as part of biobased content as it contains no carbon. It is noted that biobased content is distinct from product biodegradability. Product biodegradability measures the ability of microorganisms present in the disposal environment to completely consume the carbon components within a product within a reasonable amount of time and in a specified environment. In one example, the concentrate cleaning composition includes at least 49% biobased content. More suitably, the concentrate composition includes at least 75%, at least 80%, at least 85%, at least 90%, or at least 95% biobased content.

Additional Functional Materials

The concentrate sprayable composition may contain other functional materials that provide desired properties and functionalities to the sprayable composition. For the purposes of this application, the term "functional materials" includes a material that when dispersed or dissolved in a use solution/concentrate solution, such as an aqueous solution, provides a beneficial property in a particular use. Examples of functional materials include but are not limited to: aqueous compatible solvents, sequestrants, metal protectors, dyes/odorants, preservatives, and microbiocides.

Aqueous Compatible Solvents

The concentrate sprayable composition can contain a compatible solvent. Suitable solvents are soluble in the aqueous sprayable composition of the invention at use proportions. Preferred soluble solvents include lower alkanols, lower alkyl ethers, and lower alkyl glycol ethers. These materials are colorless liquids with mild pleasant odors, are excellent solvents and coupling agents and are typically miscible with aqueous sprayable compositions of the invention. Examples of such useful solvents include methanol, ethanol, propanol, isopropanol and butanol, isobutanol, ethylene glycol, diethylene glycol, triethylene glycol, propylene glycol, dipropylene glycol, mixed ethylene-propylene glycol ethers. The glycol ethers include lower alkyl ($C_{1-8}$ alkyl)ethers including propylene glycol methyl ether, propylene glycol ethyl ether, propylene glycol propyl ether, dipropylene glycol methyl ether, dipropylene glycol ethyl ether, tripropylene glycol methyl ether, ethylene glycol methyl ether, ethylene glycol ethyl ether, ethylene glycol butyl ether, diethylene glycol methyl ether, diethylene glycol butyl ether, ethylene glycol dimethyl ether, ethylene glycol monobutyl ether, and others. The solvent capacity of the cleaners can be augmented by using monoalkanol amines.

Sequestrants

The concentrate sprayable composition can contain an organic or inorganic sequestrant or mixtures of sequestrants. Organic sequestrants such as citric acid, the alkali metal salts of nitrilotriacetic acid (NTA), EDTA, alkali metal gluconates, polyelectrolytes such as a polyacrylic acid, sodium gluconate, and the like can be used herein.

The concentrate sprayable composition can also comprise an effective amount of a water-soluble organic phosphonic acid which has sequestering properties. Preferred phosphonic acids include low molecular weight compounds containing at least two anion-forming groups, at least one of which is a phosphonic acid group. Such useful phosphonic acids include mono-, di-, tri- and tetra-phosphonic acids which can also contain groups capable of forming anions under alkaline conditions such as carboxy, hydroxy, thio and the like. Among these are phosphonic acids having the formulae: $R_1N[CH_2PO_3H_2]_2$ or $R_2C(PO_3H_2)_2OH$, wherein $R_1$ may be -[(lower)alkylene]$N[CH_2PO_3H_2]_2$ or a third —$CH_2PO_3H_2$ moiety; and wherein $R_2$ is selected from the group consisting of $C_1C_6$ alkyl.

The phosphonic acid may also comprise a low molecular weight phosphonopolycarboxylic acid such as one having about 2-4 carboxylic acid moieties and about 1-3 phosphonic acid groups. Such acids include 1-phosphono-1methylsuccinc acid, phosphonosuccinic acid and 2-phosphonobutane-1,2,4-tricarboxylic acid.

Other organic phosphonic acids include 1-hydroxyethylidene-1,1-diphosphonic acid ($CH_3C(PO_3H_2)_2OH$), available from ThermPhos as Dequest® 2010, a 58-62% aqueous solution; amino [tri(methylenephosphonic acid)] ($N[CH_2PO_3H_2]_3$), available from ThermPhos as Dequest® 2000, a 50% aqueous solution; ethylenediamine [tetra(methylene-phosphonic acid)] available from ThermPhos as Dequest® 2041, a 90% solid acid product; and 2-phosphonobutane-1,2,4-tricarboxylic acid available from Lanxess as Bayhibit AM, a 45-50% aqueous solution. It will be appreciated that, the above-mentioned phosphonic acids can also be used in the form of water-soluble acid salts, particularly the alkali metal salts, such as sodium or potassium; the ammonium salts or the alkylol amine salts where the alkylol has 2 to 3 carbon atoms, such as mono-, di-, or tri-ethanolamine salts. If desired, mixtures of the individual phosphonic acids or their acid salts can also be used. Further useful phosphonic acids are disclosed in U.S. Pat. No. 4,051,058, the disclosure of which is incorporated by reference herein.

The sprayable composition can also incorporate a water soluble acrylic polymer which can act to condition the wash solutions under end-use conditions. Such polymers include polyacrylic acid, polymethacrylic acid, acrylic acid-methacrylic acid copolymers, hydrolyzed polyacrylamide, hydrolyzed polymethacrylamide, hydrolyzed acrylamidemethacrylamide copolymers, hydrolyzed polyacrylonitrile, hydrolyzed polymethacrylonitrile, hydrolyzed acrylonitrilemethacrylonitrile copolymers, or mixtures thereof. Water-soluble salts or partial salts of these polymers such as the respective alkali metal (e.g. sodium or potassium) or ammonium salts can also be used. The weight average molecular weight of the polymers is from about 500 to about 15,000 and is preferably within the range of from 750 to 10,000. Preferred polymers include polyacrylic acid, the partial sodium salt of polyacrylic acid or sodium polyacrylate having weight average molecular weights within the range of 1,000 to 6,000. These polymers are commercially available, and methods for their preparation are well-known in the art.

For example, commercially-available water-conditioning polyacrylate solutions useful in the present sprayable solutions include the sodium polyacrylate solution, Colloid® 207 (Colloids, Inc., Newark, N.J.); the polyacrylic acid solution, Aquatreat®AR-602-A (Alco Chemical Corp., Chattanooga, Term.); the polyacrylic acid solutions (50-65% solids) and the sodium polyacrylate powders (m.w. 2,100 and 6,000) and solutions (45% solids) available as the Goodrite® ° K-700 series from B. F. Goodrich Co.; and the sodium- or partial sodium salts of polyacrylic acid solutions (m.w. 1000-4500) available as the Acrysol® series from Rohm and Haas.

The present sprayable composition can also incorporate sequestrants to include materials such as, complex phosphate sequestrants, including sodium tripolyphosphate, sodium hexametaphosphate, and the like, as well as mixtures thereof. Phosphates, the sodium condensed phosphate hardness sequestering agent component functions as a water softener, a cleaner, and a detergent builder. Alkali metal (M) linear and cyclic condensed phosphates commonly have a $M_2O:P_2O_5$ mole ratio of about 1:1 to 2:1 and greater. Typical polyphosphates of this kind are the preferred sodium tripolyphosphate, sodium hexametaphosphate, sodium metaphosphate as well as corresponding potassium salts of these phosphates and mixtures thereof. The particle size of the phosphate is not critical, and any finely divided or granular commercially available product can be employed.

Sodium tripolyphosphate is another inorganic hardness sequestering agent. Sodium tripolyphosphate acts to sequester calcium and/or magnesium cations, providing water softening properties. It contributes to the removal of soil from hard surfaces and keeps soil in suspension. It has little corrosive action on common surface materials and is low in cost compared to other water conditioners. Sodium tripolyphosphate has relatively low solubility in water (about 14 wt %) and its concentration must be increased using means other than solubility. Typical examples of such phosphates being alkaline condensed phosphates (i.e., polyphosphates) such as sodium or potassium pyrophosphate, sodium or potassium tripolyphosphate, sodium or potassium hexametaphosphate, etc.

Metal Protectors

The sprayable composition can contain a material that can protect metal from corrosion. Such metal protectors include for example sodium gluconate and sodium glucoheptonate.

Dyes/Odorants

Various dyes, odorants including perfumes, and other aesthetic enhancing agents may also be included in the compositions. Examples of suitable commercially available dyes include, but are not limited to: Direct Blue 86, available from Mac Dye-Chem Industries, Ahmedabad, India; Fastusol Blue, available from Mobay Chemical Corporation, Pittsburgh, Pa.; Acid Orange 7, available from American Cyanamid Company, Wayne, N.J.; Basic Violet 10 and Sandolan Blue/Acid Blue 182, available from Sandoz, Princeton, N.J.; Acid Yellow 23, available from Chemos GmbH, Regenstauf, Germany; Acid Yellow 17, available from Sigma Chemical, St. Louis, Mo.; Sap Green and Metanil Yellow, available from Keystone Aniline and Chemical, Chicago, Ill.; Acid Blue 9, available from Emerald Hilton Davis, LLC, Cincinnati, Ohio; Hisol Fast Red and Fluorescein, available from Capitol Color and Chemical Company, Newark, N.J.; and Acid Green 25, Ciba Specialty Chemicals Corporation, Greenboro, N.C.

Examples of suitable fragrances or perfumes include, but are not limited to: terpenoids such as citronellol, aldehydes such as amyl cinnamaldehyde, a jasmine such as C1S-jasmine or jasmal, and vanillin.

Surface Chemistry Modifiers

Various surface chemistry modifiers can be incorporated into the concentrate sprayable composition. Examples of suitable commercially available surface chemistry modifiers include Laponite® silicates available from Southern Clay Products, Inc. The surface chemistry modifiers may have high surface free energy and high surface area which leads to interactions with many types of organic compounds. In one example, suitable surface chemistry modifiers have a surface free energy of about 200 mjoules/meter$^2$ and a surface area of between about 750 and 800 m$^2$/gram. A suitable concentration range for surface chemistry modifiers in the use solution is between about 10 ppm and about 100 ppm.

Use Solution

The concentrate sprayable composition can be diluted with water, known as dilution water, to form a use solution. In general, a concentrate refers to a composition that is intended to be diluted with water to provide a use solution; a use solution is dispersed or used without further dilution.

The resulting use solution has a relatively low anti-mist component concentration. In one suitable use solution, the concentration of PEO is between about 0.002% and about 0.006% by weight. In another example, the concentration of PEO is between about 0.003% and 0.005%. In a further example, the concentration of PEO is in the concentrated sprayable solution can be 10 to 200 times greater than the PEO concentration of the use solution.

In another suitable use solution, the polyacrylamide concentration is between about 0.002% and 0.01% by weight. In a particularly suitable use solution, the polyacrylamide concentration is between about 0.003% and about 0.007% by weight.

In a further suitable use solution, the concentration of PEO, PAA or a combination thereof is between about 0.002% and about 0.006% by weight. In another example, the concentration of PEO, PAA or a combination thereof is between about 0.003% and 0.005%. In a further example, the concentration of PEO, PAA or a combination thereof is in the concentrated sprayable solution can be 10 to 200 times greater than the PEO concentration of the use solution.

As discussed above, the anti-mist component may alternatively be polyacrylate. In one suitable use solution, the polyacrylate concentration is greater than about 0.1% by weight. In another example, the polyacrylate concentration is between about 0.2% and about 5.0% by weight. In a further example, the polyacrylate concentration is between about 0.3% and about 3.0% by weight.

The resulting use solution can also have a relative low stability component concentration. In one suitable use solution, the stability component concentration is between about 0.003% and about 10% by weight.

As discussed above, the concentrate sprayable composition may include an acid. The acid may be present in a sufficient amount such that the solution has a pH of 4.5 or lower. In one example, a suitable acid concentration in the use solution is between about 0.1% and 10% by weight of the use solution. The amount of acid present in the use solution may depend on whether the acid is a strong acid or a weak acid. Strong acids may have a greater tendency to lose protons such that a lower amount of strong acid is necessary to achieve the same pH compared to a weak acid. In one example, the use solution contains between about 0.1% to about 1% strong acid. In another example, the use solution contains between about 1% and about 10% weak acid.

The use solution can be dispensed using an aerosol sprayer or transient stock trigger sprayer (i.e., non-low velocity trigger), which results in limited drifting, misting, and/or atomization of the aqueous use solution. Example transient stock trigger sprayers include but are not limited to Calmar Mixor HP 1.66 output trigger sprayer. Reduction in drift, misting, and atomization can be determined from the droplet size of the applied solution, with an increased droplet size indicating reduced misting and atomization. The increased droplet size also reduces inhalation of the use solution. Preferably, the median droplet size is about 10 mircons or greater, about 50 microns or greater, about 70 microns or greater, about 100 microns or greater, about 150 microns or greater and preferably about 200 microns or greater. There are several methods for determining droplet size including, but not limited to, adaptive high speed cameras, laser diffraction, and phase Doppler particle analysis. Commercially available laser diffraction apparatuses include Spraytec available from Malvern and Helos available from Sympatec.

When the use solution containing the anti-mist component is dispersed with a transient trigger sprayer, the resulting droplet size is increased compared to the same sprayable solutions not containing the anti-mist component. A suitable use solution containing the anti-mist component and sprayed with a stock sprayer results in less than about 0.5% droplets having a droplet size below 11 microns, and more particularly less than about 0.4% droplets having a droplet size below 11 microns, and more particularly less than 0.1% droplets having a droplet size below 11 microns. In one example, an unmodified ready-to use solution had 1.3% of droplets below 11 microns while the same use solution modified with 0.003% polyethylene oxide had 0.65% of droplets below 11 microns when dispersed with the same transient spray trigger.

The use solution may also be dispensed using a low velocity trigger sprayer, such as those available from Calmar. A typical transient trigger sprayer includes a discharge valve at the nozzle end of the discharge end of a discharge passage. A resilient member, such as a spring, keeps the discharge valve seated in a closed position. When the fluid pressure in the discharge valve is greater than the force of the resilient member, the discharge valve opens and disperses the fluid. A typical discharge valve on a stock trigger sprayer is a throttling valve which allows the user to control the actuation rate of the trigger sprayer. The actuation rate of the discharge valve determines the flow velocity, and a greater velocity results in smaller droplets. A low velocity trigger sprayer can contain a two-stage pressure build-up discharge valve assembly which regulates the operator's pumping stroke velocity and produces a well-defined particle size. In one example, the two-stage pressure build-up discharge valve can include a first valve having a high pressure threshold and a second valve having a lower pressure threshold so that the discharge valve snaps open and closed at the beginning and end of the pumping process. Example low-velocity trigger sprayers are commercially available from Calmar and are described in U.S. Pat. No. 5,522,547 to Dobbs and U.S. Pat. No. 7,775,405 to Sweeton, which are incorporated in their entirety herein. The low velocity trigger sprayers may result in less drifting, misting and atomization of the use solution, and may reduce the amount of small droplets dispensed. The sprayable composition containing an antimist component may work in synergy with the low velocity trigger sprayer to produce a greater increase in droplet size than expect based on the components alone. In one example, a use solution containing the anti-mist component sprayed with a low velocity trigger sprayer resulted in 0% droplets having a droplet size below 11 microns.

The use solution is a non-Newtonian liquid. When not under stress, the use solution has a viscosity similar to water. For example, in one embodiment, the use solution has a viscosity less than about 40 centipoise.

As discussed above, the anti-mist component may increase the droplet size of the use solution when dispensed. The anti-mist component may also increase the average flight distance of the use solution when dispensed from a trigger sprayer. Increasing the average flight distance allows a user to be further away from the target hard surface and may decrease the likelihood of inhaling particulates, particularly particulates that rebound off of the hard surface.

Embodiments

The present invention relates to aqueous concentrate sprayable compositions including an anti-mist component, such as polyethylene oxide and polyacrylamide, and use solutions thereof. The concentrate sprayable composition of the current invention can be diluted with dilution water to form a use solution, which can be applied to a surface to remove soil using a sprayer device.

Exemplary ranges for components of the sprayable composition when provided as a concentrate acidic cleaner, a concentrate highly acidic cleaner, a concentrate neutral quaternary cleaner, a concentrate air freshener, and a concentrate glass window cleaner are provide in Tables 1-6, respectively. Tables 1-6 provided exemplary ranges when the anti-mist component is PEO, PAA or combination thereof and when the anti-mist component is polyacryalte.

TABLE 1

Concentrate Acidic Cleaner Composition

| Component | Exemplary Range (wt %) PEO, PAA, combinations | Exemplary Range (wt %) Polyacrylate |
|---|---|---|
| Water | 45-75 | 45-75 |
| Acid | 7-35 | 7-35 |
| Solvent | 3-15 | 3-15 |
| Non-ionic surfactant | 1-5 | 1-5 |
| Cationic surfactant | 0.5-5 | 0.5-5 |
| Fragrance & dye | 0.005-0.3 | 0.005-0.3 |
| Anti-mist component | 0.01-0.3 | 0.5-20 |
| Stability component | 0-10 | 0-10 |

The concentrate acidic cleaner composition of Table 1 can be diluted with water to about 5%-15% concentrate to form a use solution. For example, the use solution of the concentrate acidic cleaner of Table 1 can have a concentration of PEO, PAA or a combination thereof between about 0.002% and about 0.006% by weight. Suitable acid concentrations in the use solution include between about 0.1% and about 10% by weight of the use solution.

TABLE 2

| Concentrate Highly Acidic Cleaner Composition I | | |
|---|---|---|
| Component | Exemplary Range (wt %) PEO, PAA, combinations | Exemplary Range (wt %) Polyacrylate |
| Water | 25-50 | 25-50 |
| Acid | 10-75 | 10-75 |
| Surfactant | 1.3-10 | 1.3-10 |
| Anti-mist component | 0.01-0.3 | 0.5-20 |
| Stability component | 0-10 | 0-10 |

The concentrate highly acidic cleaner composition of Table 2 can be diluted with water to about 5%-15% concentrate to form a use solution. For example, the use solution of the concentrate acidic cleaner of Table 2 can have a concentration of PEO, PAA or a combination thereof between about 0.002% and about 0.006% by weight. Suitable acid concentrations in the use solution include between about 0.1% and about 10% by weight of the use solution.

TABLE 3

| Concentrate Highly Acidic Cleaner Composition II | | |
|---|---|---|
| Component | Exemplary Range (wt %) PEO, PAA, combinations | Exemplary Range (wt %) Polyacrylate |
| Acid, including a fatty acid antimicrobial agent | 7-45 | 7-45 |
| Nonionic surfactant | 0.1-30 | 0.1-30 |
| Anti-mist component | 0.01-0.3 | 0.5-20 |
| Stability component | 0-10 | 0-10 |

Suitable nonionic surfactants can be branched or unbranched ethoxylated amine according to one of the following formulas:

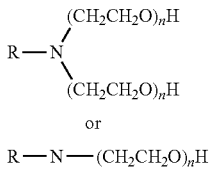

R can be a straight or branched alkyl or alkylaryl substituent. R can be a substituent having from 1 to 24 carbon atoms and each n can be from 1 to 20. R can be derived from coconut oil and n can be between 1 to 14, preferably between 6 to 12 and have an HLB from approximately 10 to 14, where HLB represents the empirical expression for the hydrophilic and hydrophobic groups of the surfactant, and the higher the HLB value the more water-soluble the surfactant. In one suitable branched ethoxylated amine the total EO groups (n+n) are preferably between 6 to 12 or 6 to 10. In another suitable ethoxylated anime, R can be capped or terminated with ethylene oxide, propylene oxide, or butylene oxide units. A suitable CAS number for an ethoxylated amine can be 61791-14-8.

The nonionic surfactant may be a medium to short chain carbon group having less than 24 carbon atoms that does not include an alcohol. The ethoxylated amine may also be a cocoamine Ethoxylated cocoamines are commercially available, for example, under tradenames such as Varonic (Evonik Industries) and Toximul (Stepan Company), including Varonic K-210 and Toximul CA 7.5.

The concentrate highly acid cleaner composition of Table 3 can be diluted with water to form a use solution having an acid concentration, including a fatty acid antimicrobial agent, between about 1% and about 10% by weight. In another example, the use solution of the concentration acidic cleaner of Table 3 can have a concentration of PEO, PAA or a combination thereof between about 0.002% and about 0.006% by weight.

TABLE 4

| Concentrate Neutral Quaternary Cleaner Composition | | |
|---|---|---|
| Component | Exemplary Range (wt %) PEO, PAA, combinations | Exemplary Range (wt %) Polyacrylate |
| Water | 75-95 | 75-95 |
| Quaternary compound | 5-30 | 5-30 |
| Dye | 0.002-0.01 | 0.002-0.01 |
| Anti-mist component | 0.01-0.3 | 0.5-20 |
| Stability component | 0-10 | 0-10 |

The concentrate neutral quaternary cleaner composition of Table 4 can be diluted with water to about 0.1%45% concentrate to form a use solution. In one example, the use solution of the concentrate neutral quaternary cleaner composition of Table 4 can have a concentration of PEO, PAA or a combination thereof between about 0.002% and about 0.006% by weight. The use solution of the concentrate neutral quaternary cleaner composition can have a pH between about 5 and about 11.

TABLE 5

| Concentrate Air Freshener Composition | | |
|---|---|---|
| Component | Exemplary Range (wt %) PEO, PAA, combinations | Exemplary Range (wt %) Polyacrylate |
| Water, zeolite softened | 50-90 | 50-90 |
| Nonionic surfactant | 1-15 | 1-15 |
| Microbiocide | 0-0.1 | 0-0.1 |
| Anionic surfactant | 1-10 | 1-10 |
| Fragrance & dye | 0.05-15 | 0.05-15 |
| Anti-mist component | 0.01-0.3 | 0.5-20 |
| Stability component | 0-10 | 0-10 |

The concentrate air freshener composition of Table 5 can be diluted with water to about 3%-10% concentrate to form a use solution.

TABLE 6

| Concentrate Window Glass Cleaning Composition | |
|---|---|
| Component | Exemplary Range (wt %) PEO, PAA, combinations |
| Water | 20-99.9 |
| Dispersent | 0-5 |
| Sheeting agent | 0-0.05 |
| Chelant | 0-10 |
| Solvent or glycerine | 0.05-30 |
| Surfactant | 0.01-50 |
| Fragrance & dye | 0-0.7 |
| Anti-mist component | 0.01-0.3 |
| Stability component | 0-10 |

The concentrate window glass cleaning composition of Table 6 can be diluted with water to about 0.5%-10% concentrate to form a use solution. The use solution can have a pH between about 3 and about 10.

The concentrate compositions disclosed above in Tables 1-6 may be further concentrated to further reduce the amount of water required to be transported and stored. In one example, the concentrate compositions of Tables 1-6 are concentrated 2 to 4 times. For example, PEO and/or PAA may be present in an amount of between about 0.02% to about 1.2% by weight of the composition, and polyacryalte may be present in an amount of between about 0.5% to about 30% by weight of the concentrate composition. The stability component may present in concentrations up to about 20% by weight or up to about 40% by weight of the concentrate composition.

EXAMPLES

The present invention is more particularly described in the following examples that are intended as illustrations only, since numerous modifications and variations within the scope of the present invention will be apparent to those of skill in the art. Unless otherwise noted, all parts, percentages, and ratios reported in the following examples are on a weight basis, and all reagents used in the examples were obtained or are available from the chemical suppliers described below or may be synthesized by conventional techniques.

Materials Used

Acusol™ 460N: a sodium polycarboxylate (25% active) available from Dow Chemical, Midland, Mich.

Ammonium Hydroxide available from HVC Cincinnati, Ohio

Aquatreat® AR-7-H: a 1.2 million molecular weight polyacrylate polymer (10%-30% active) available from Azko Nobel Dissolvine®GL-38: a glutamic acid, N,N-diacetic acid, tetra sodium salt available from Akzo Nobel Dissolvine®GL-47-S: a tetrasodium glutamate diacetate available from Akzo Nobel Glucopon® 215 UP: an aqueous solution of alkyl polyglycosides based on a natural fatty alcohol C8-C10 available from BASF Corporation, Florham Park, N.J.

Glucopon® 425N: an alkyl polyglycoside surfactant available from BASF Corporation, Florham Park, N.J.

Irganox® 1135: a liquid hindered phenolic antioxidant available from Ciba
Specialty Chemicals Irganox® 5057: a liquid aromatic amine antioxidant available from Ciba Specialty Chemicals KF 1955: a fragrance available from Klabin Fragrances, Cedar Grove, N.J.

Liquitint® patent blue: a colourant available from Albright & Wilson, Australia

Oasis® 146: a neutral quaternary cleaner containing at use dilution about 0.036% quaternary ammonium compound and available from Ecolab, St. Paul, Minn.

Oasis® 285: an air freshener solution having a neutral pH and available from Ecolab, St. Paul, Minn.

Oasis® 299: an acidic liquid cleaner and disinfectant available from Ecolab, St. Paul, Minn.

Pluronic® N-3: an ethylene oxide and propylene oxide based block copolymer available from BASF Corporation, Florham Park, N.J.

Polyox™ WSR 301: a non-ionic polyethylene oxide having a molecular weight of 4,000,00 and available from Dow Chemical, Midland, Mich.

Tinogard® NOA: an antioxidant available from BASF

Trilon® M: an aqueous solution of the trisodium salt of methylglycinediacetic acid (Na3MGDA) available from BASF Corporation, Florham Park, N.J.

Zemea®: Propanediol available from DuPont Tate & Lyle BioProducts

Window Cleaner A concentrate: formulated according to Table A

Lemon-Lift®: a ready to use alkaline bleach detergent available from Ecolab, St. Paul, Minn.

TABLE A

| | |
|---|---|
| Deionized water | 0-99.9% |
| Sodium polycarboxylates | 0-5% |
| EO/PO block co-polymers | 0-5% |
| Amino carboxylate | 0-10% |
| Propylene glycol | 0.05-30% |
| Alkyl polyglycoside | 0.05-50% |
| Fragrance | 0-1% |
| Dye | 0-1% |

Highly acidic cleaner A concentrate: formulated according to Table B

TABLE B

| | |
|---|---|
| Water | 25-50% |
| Lactic acid, 88% | 5-25% |
| Glucopon 425 N, 50% | 5-15% |
| Citric acid, anhydrous | 30-60% |

Example 1

Elongational Viscosity

Elongational resistance can be measured with the apparatuses such as those described in R. W. Dexter, *Atomization and Sprays*, vol. 6, pp. 167-197, 1996, which is herein incorporated by reference. The apparatus used to measure elongational viscosity in Example 1 comprised five 100-mesh screens packed tightly on top of each other at the base of a 50 mL burette containing a measurable amount of liquid. The mesh screens were contained in an adapter and tubing positioned at the base of the burette. The burette was 74 cm long and had a diameter of 1.5 cm. The adapter and tubing had a length of 10.5 cm, and the mesh screens (i.e., the area available for flow through the adapter and tubing) had a diameter of 1.2 cm. The liquid was forced through the tortuous path formed by the many fine orifices. The time taken for 50 mL of a liquid to flow through the apparatus was measured and correlated to a shear viscosity. The longer the time taken to flow through the packed bed of mesh, the more resistance, and hence, the higher the elongational viscosity.

Aqueous solutions comprising Polyox WSR 301 or xanthan gum were prepared according to Table 6, and the time required for 50 grams of the aqueous solution to flow through the apparatus was measured.

TABLE 6

| Sample | Component | Shear viscosity (cPs) | Time (Sec) |
|---|---|---|---|
| 1 | Water | 9.6 | 146 |
| 2 | 0.1% Polyox | 22.4 | 325 |
| 3 | 0.05% Polyox | 14 | 265 |
| 4 | 0.01% Polyox | 14 | 180.3 |
| 5 | 0.005% Polyox | 15.8 | 165 |
| 6 | 0.1% xanthan gum | 56.6 | 242 |

As shown in Table 6, the Polyox WSR 301 containing samples took longer to flow through the apparatus while having shear viscosities similar to water. In comparison, the shear viscosity of Sample 6, which contained xanthan gum, was larger than that of water. The increased time to flow through the apparatus indicated an increased elongational viscosity.

Samples 2-5, which each includes Polyox, has a viscosity similar to that of water and an elongational viscosity greater than water. The increased elongational viscosity may result in increased droplet size and reduced misting. In comparison, the xanthan gum produced a composition having a significantly increased shear viscosity and elongational viscosity. Because xanthan gum results in an increased shear viscosity and elongational viscosity, xanthan gum would result in a concentrate composition that is too thick for use.

Example 2

Stability Test

Various concentrate aqueous sprayable solutions were tested to determine their temperature stability. The concentrate sprayable solutions were tested at room temperature (20° Celsius to 25° Celsius), 120° Fahrenheit, 4° Celsius. Observations were made after 96 hours, 240 hours, 336 hours, and 4 weeks. The concentrate sprayable solutions were also exposed to freeze thaw cycles, in which the solutions were frozen and then allowed to thaw at room temperature. The solutions were exposed to four total freeze thaw cycles and observations were made after each cycle.

Sample 7

For Sample 7, polyethylene oxide was added to concentrate Oasis 299. The component concentrations of the solutions are presented below in Table 7.

TABLE 7

| | Sample 7 |
|---|---|
| Polyox WSR 301 | 0.018 g |
| Propylene glycol | 0.1 g |
| Oasis 299 | 99.88 g |
| Total | 100 g |

There was no visually noticeable change in the elongational viscosity or other visually observable property for Sample 7 stored at 120° Fahrenheit, 4° Celsius, and room temperature after 96 hours, 240 hours, 336 hours, and 4 weeks. After three freeze/thaw cycles, Sample 7 contained ghost tails which disappeared after inversion of the solution. Similar ghost tails were observed after the fourth freeze/thaw cycle of Sample 7, and these ghost tails disappeared after two rotations of the solution. The ghost tails may be caused by decreased solubility of one of the components due to a decrease in temperature. The particulates disappeared after mechanical disturbance (such as mixing) or by returning the solution to room temperature.

Sample 8

For Sample 8, polyethylene oxide was added to Window Cleaner A concentrate of Table A. The component concentrations of Sample 8 are presented below in Table 8.

TABLE 8

| | Sample 8 |
|---|---|
| Polyox WSR 301 | 0.054 g |
| Propylene glycol | 0.1 g |
| Window Cleaner A concentrate | 99.85 g |
| Total | 100 g |

After 96 hours, 240 hours, 336 hours, and four weeks at 120° Fahrenheit, 4° Celsius and room temperature, no noticeable change in elongational viscosity or other visually observable property was visually observed for Sample 8. No noticeable change was observed after one and two freeze/thaw cycles of Sample 8. After three freeze/thaw cycles of Sample 8, ghost tails were present but disappeared after inversion of the solution. Similar ghost tails were observed after the fourth freeze/thaw cycle of Sample 8, and these ghost tails disappeared after two rotations of the solution.

Sample 9

For Sample 9, polyethylene oxide was added at 0.001-0.05% to a ready to use solution of Lemon-Lift. The polyethylene oxide appeared to be quickly degraded, and Sample 10 did not pass the stability tests.

Example 3

Spray Tests

Comparative Samples A and B

Ready to use solutions were formed from concentrate Samples 7 and 8. The ready to use solutions were sprayed with a trigger sprayer available from Calmar and the mist or aerosol produced by each sample was noted. After four weeks of storage at the specified temperature or four freeze/thaw cycles, concentrate Samples 7 and 8 were returned to room temperature and were diluted with water to form ready-to-use solutions (RTU). Calmar Mixor HP 1.66 output trigger sprayer was used to spray each sample onto a hard surface. The Calmar Mixor HP is not a low-velocity sprayer. The spray test results of RTU Samples 7 and 8 were visually compared to Comparative Samples A and B, respectively. RTU Sample 7 was formed by diluting the formulations of Sample 7 with water at an 5-15% dilution ratio. Comparative Sample A was a ready to use solution of Oasis 299 prepared by diluting liquid concentrate Oasis 299 with water at an 5-15% dilution ratio. RTU Sample 8 was formed by diluting Sample 8 with water to form a solution containing 0.5-10% concentrate by weight. Comparative Sample B was a ready to use solution of window cleaner prepared by diluting Window Cleaner A concentrate with water to form a solution containing 0.5-10% Window Cleaner A concentrate by weight. The visual observations are presented in Table 9 below.

TABLE 9

| RTU Sample | Temperature | Observations |
|---|---|---|
| RTU Sample 7 | Four freeze/thaw cycles | Visually reduced misting and increased foaming compared to Comparative Sample A |

TABLE 9-continued

| RTU Sample | Temperature | Observations |
|---|---|---|
| RTU Sample 7 | 4° C. | Visually reduced misting compared to Comparative Sample A |
| RTU Sample 7 | 120° F. | Marked, noticeable increase in misting compared to RTU Sample 8 after four freeze/thaw cycles or stored at 4° C. or room temperature; reduced misting compared to Comparative Sample A |
| RTU Sample 7 | Room temperature | Visually reduced misting and increased foaming compared to Comparative Sample A |
| RTU Sample 8 | Four freeze/thaw cycles | Noticeably narrower spray compared to Comparative Sample B; reduced misting around the spray pattern |
| RTU Sample 8 | 4° C. | Noticeably narrower spray compared to Comparative Sample B; reduced misting around the spray pattern |
| RTU Sample 8 | 120° F. | Increased misting compared to RTU Sample 10 after four freeze/thaw cycles or stored at 4° C. or room temperature; Reduced misting Comparative Sample B |
| RTU Sample 8 | Room temperature | Noticeably narrower spray compared to Comparative Sample B; reduced misting around the spray pattern |

The addition of polyethylene oxide (Polyox WSR 301) reduced misting in Oasis 299 and Window Cleaner A. The reduction was seen in samples stored at 4° C., room temperature and those subjected to freeze/thaw cycles. Samples stored at 120° F. also showed an improvement.

Samples 10-37 and Comparative Samples C, D and E

Stability components were investigated to lengthen the shelf life of the concentrate solutions. A stability component was added to concentrate Oasis 299 according to Table 10 and the solutions were stored for four weeks at 120° F. All solutions contained concentrate Oasis 299, 0.042% by weight Polyox WSR 301, and the specified stability component.

TABLE 10

| Sample | Irganox 5057 | Isoascorbic acid | Ascorbic acid | Dissolvine GL-38 | Propylene glycol | Glycerine | Sodium metabisulfite |
|---|---|---|---|---|---|---|---|
| 10 | 7000 ppm | 0 | 0 | 0 | 0 | 0 | 0 |
| 11 | 5000 ppm | 0 | 0 | 0 | 0 | 0 | 0 |
| 12 | 3000 ppm | 0 | 0 | 0 | 0 | 0 | 0 |
| 13 | 1000 ppm | 0 | 0 | 0 | 0 | 0 | 0 |
| 14 | 0 | 10,000 ppm | 0 | 0 | 0 | 0 | 0 |
| 15 | 0 | 7000 ppm | 0 | 0 | 0 | 0 | 0 |
| 16 | 0 | 4000 ppm | 0 | 0 | 0 | 0 | 0 |
| 17 | 0 | 500 ppm | 0 | 0 | 0 | 0 | 0 |
| 18 | 0 | 0 | 10,000 ppm | 0 | 0 | 0 | 0 |
| 19 | 0 | 0 | 7000 ppm | 0 | 0 | 0 | 0 |
| 20 | 0 | 0 | 4000 ppm | 0 | 0 | 0 | 0 |
| 21 | 0 | 0 | 500 ppm | 0 | 0 | 0 | 0 |
| 22 | 0 | 0 | 0 | 50,000 ppm | 0 | 0 | 0 |
| 23 | 0 | 0 | 0 | 20,000 ppm | 0 | 0 | 0 |
| 24 | 0 | 0 | 0 | 5000 ppm | 0 | 0 | 0 |
| 25 | 0 | 0 | 0 | 3000 ppm | 0 | 0 | 0 |
| 26 | 0 | 0 | 0 | 0 | 50,000 ppm | 0 | 0 |
| 27 | 0 | 0 | 0 | 0 | 10,000 ppm | 0 | 0 |
| 28 | 0 | 0 | 0 | 0 | 5000 ppm | 0 | 0 |
| 29 | 0 | 0 | 0 | 0 | 1000 ppm | 0 | 0 |
| 30 | 0 | 0 | 0 | 0 | 0 | 50,000 ppm | 0 |
| 31 | 0 | 0 | 0 | 0 | 0 | 10,000 ppm | 0 |
| 32 | 0 | 0 | 0 | 0 | 0 | 5000 ppm | 0 |
| 33 | 0 | 0 | 0 | 0 | 0 | 1000 ppm | 0 |
| 34 | 0 | 0 | 0 | 0 | 0 | 0 | 10,000 ppm |
| 35 | 0 | 0 | 0 | 0 | 0 | 0 | 5000 ppm |
| 36 | 0 | 0 | 0 | 0 | 0 | 0 | 1000 ppm |
| 37 | 0 | 0 | 0 | 0 | 0 | 0 | 500 ppm |

After four weeks, the concentrate solutions were removed from the oven and allowed to return to room temperature. The concentrate solutions were then diluted with water to form 5-15% concentrate ready-to-use solutions. The ready-to-use solutions were sprayed with stock trigger sprayers and the mist or aerosol of each was noted. The spray test results of Samples 10-37 were visually compared to that of Comparative Samples C, D and E. Comparative Sample C was concentrate Oasis 299 containing 0.042% by weight Polyox and stored at room temperature for four weeks. Comparative Sample D was concentrate Oasis 299 containing 0.042% by weight Polyox and stored at 120° F. for four weeks. Comparative Sample E was concentrate Oasis 299 containing 0.042% by weight Polyox and stored in the dark at room temperature for four weeks.

Samples 10-13 and Samples 22-25 exhibited reduced misting compared to the Comparative Sample D. This suggests that Irganox 5057 and GL-38 increase the stability of the anti-mist polymer. None of the other Samples significantly reduced misting compared to Comparative Sample D.

Samples 38-57

Polyacrylamide was investigated as an anti-mist component and additives were added to investigate improved shelf-life. Samples 38-57 included concentrate Oasis 299, 0.0736% SuperFloc N-300 by weight and an additive according to Table 11.

TABLE 11

| Sample | Irganox 5057 | Isoascorbic acid | Ascorbic acid | Dissolvine GL-47 | Propylene glycol | Glycerine |
|---|---|---|---|---|---|---|
| 38 | 5000 ppm | 0 | 0 | 0 | 0 | 0 |
| 39 | 1000 ppm | 0 | 0 | 0 | 0 | 0 |
| 40 | 500 ppm | 0 | 0 | 0 | 0 | 0 |
| 41 | 0 | 4000 ppm | 0 | 0 | 0 | 0 |
| 42 | 0 | 1000 ppm | 0 | 0 | 0 | 0 |
| 43 | 0 | 500 ppm | 0 | 0 | 0 | 0 |
| 44 | 0 | 0 | 4000 ppm | 0 | 0 | 0 |
| 45 | 0 | 0 | 1000 ppm | 0 | 0 | 0 |
| 46 | 0 | 0 | 500 ppm | 0 | 0 | 0 |
| 47 | 0 | 0 | 0 | 20,000 ppm | 0 | 0 |
| 48 | 0 | 0 | 0 | 5000 ppm | 0 | 0 |
| 49 | 0 | 0 | 0 | 3000 ppm | 0 | 0 |
| 50 | 0 | 0 | 0 | 0 | 50,000 ppm | 0 |
| 51 | 0 | 0 | 0 | 0 | 10,000 ppm | 0 |
| 52 | 0 | 0 | 0 | 0 | 5000 ppm | 0 |
| 53 | 0 | 0 | 0 | 0 | 1000 ppm | 0 |
| 54 | 0 | 0 | 0 | 0 | 0 | 50,000 ppm |
| 55 | 0 | 0 | 0 | 0 | 0 | 10,000 ppm |
| 56 | 0 | 0 | 0 | 0 | 0 | 5000 ppm |
| 57 | 0 | 0 | 0 | 0 | 0 | 1000 ppm |

After four weeks storage at 120° F., the concentrate solutions were removed from the oven and allowed to return to room temperature. The concentrate solutions were then diluted with water to form 5-15% RTU solutions having a SuperFloc N-300 concentration of 0.007% by weight. The RTU solutions of Samples 38-57 were sprayed using a stock sprayer and visual observations regarding the misting and aerosol of each can be noted. These visual results were compared to that for the RTU solutions of Comparative Samples C, D, and E.

Samples 38-40 and Samples 47-49 exhibited reduced misting compared to the Comparative Sample D. This suggests that Irganox 5057 and GL-47 increase the stability of the anti-mist polymer. None of the other Samples significantly reduced misting compared to Comparative Sample D.

Example 4

Droplet Size

Samples 58-65

The droplet size distributions of cleaners modified with polyethylene oxide were compared to cleaners that were not modified (i.e., did not contain polyethylene oxide). The droplet size distributions were determined using a HELOS apparatus available from Sympatec GmbH, Clausthal-Zellerfeld, Germany. HELOS determines droplet size by laser diffraction. The droplet size distributions were determined for ready-to-use solutions dispensed with stock trigger sprayers and with low velocity sprayers available from Calmar.

To analyze particle size using the Sympatec Helos particle size analyzer, the switch on the particle size analyzer was turned to the #2 position. If the switch was originally in the #0 position, the unit was allowed to stabilize for 30 minutes before testing began. If the switch was originally in the #1 position, the stabilization time was not required and the test could be started immediately. The Sympatec Helos particle size analyzer was in communication with a computer which ran software designed to interpret data from the particle size analyzer.

The Sympatec Helos particle size analyzer is capable of measuring drop sizes only in certain ranges depending on the lenses used. The desired lens was placed on the particle size analyzer and a reference measurement was performed to calibrate the particle size analyzer.

A sprayer with the test medium was primed. The sprayer was then placed so that the orifice of the sprayer was 8 inches from the lens and the center of the spray went through the laser. The conduct the test, the sprayer was actuated three times at 90 strokes per minute using an automatic actuator. The computer software calculated the particles size distributions.

Samples 58-65 were ready-used-solutions formed by diluting the respective concentrate base cleaning composition with water to form a solution containing the weight percentages indicated in Table 12. Modified concentrate base cleaning compositions were formed by added a sufficient amount of polyethylene oxide so that when diluted the respective ready-to-use solution contained 0.003% polyethylene oxide by weight.

TABLE 12

| Sample | Concentrate base cleaning composition | Dilution concentration |
|---|---|---|
| 58 | Oasis 285 | 3-10% |
| 59 | Oasis 146 | 0.1-0.5% |
| 60 | Oasis 299 | 5-15% |
| 61 | Window Cleaner A (W.C.) | 0.5-10% |
| 62 | Modified Oasis 285 | 3-10% |
| 63 | Modified Oasis 146 | 0.1-0.5% |
| 64 | Modified Oasis 299 | 5-15% |
| 65 | Modified Window Cleaner A (W.C.) | 0.5-10% |

FIG. 1 illustrates the percentage of droplets below 11 microns for Samples 58-65 when dispensed with a Calmar Mixor HP 1.66 cc output sprayer (i.e., a non-low velocity sprayer). As shown in FIG. 1, the addition of 0.003% polyethylene oxide decreases the percentage of droplets below 11 microns in Oasis 285, Oasis 146, Oasis 299, and Window Cleaner A (W.C.). The percentage of particles 11 microns or above are of interest because it is believed that particles of this size are more resistant to inhalation into the throat and lungs. On average, the addition of 0.003% polyethylene oxide significant decreases the percentage of droplets below 11 microns in Oasis 285, Oasis 146, Oasis 299, and Window Cleaner A by 53%.

Figure 2:
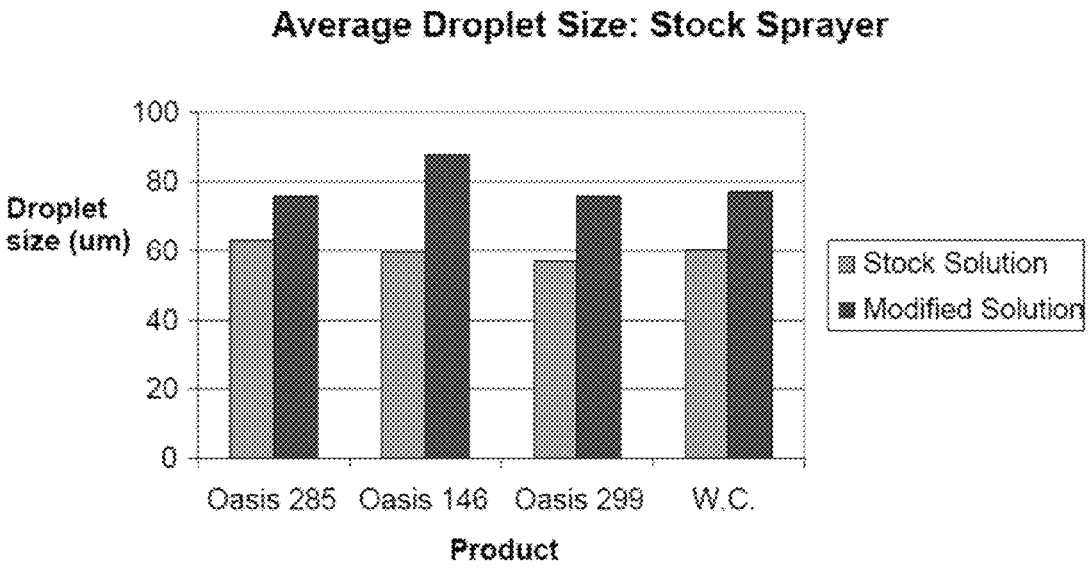
FIG. 2 illustrates average droplet size for stock ready to use sprayable solutions and ready to use sprayable solutions modified with polyethylene oxide when applied with a stock trigger sprayer.

FIG. 2 illustrates the average droplet size for each stock and modified solution when applied with a Calmar Mixor HP 1.66 cc output sprayer (i.e., a non-low velocity sprayer). The addition of 0.003% polyethylene oxide increased the average droplet size in Oasis 285, Oasis 146, Oasis 299, and Window Cleaner A (W.C.) by an average of 28%.

Figure 3:
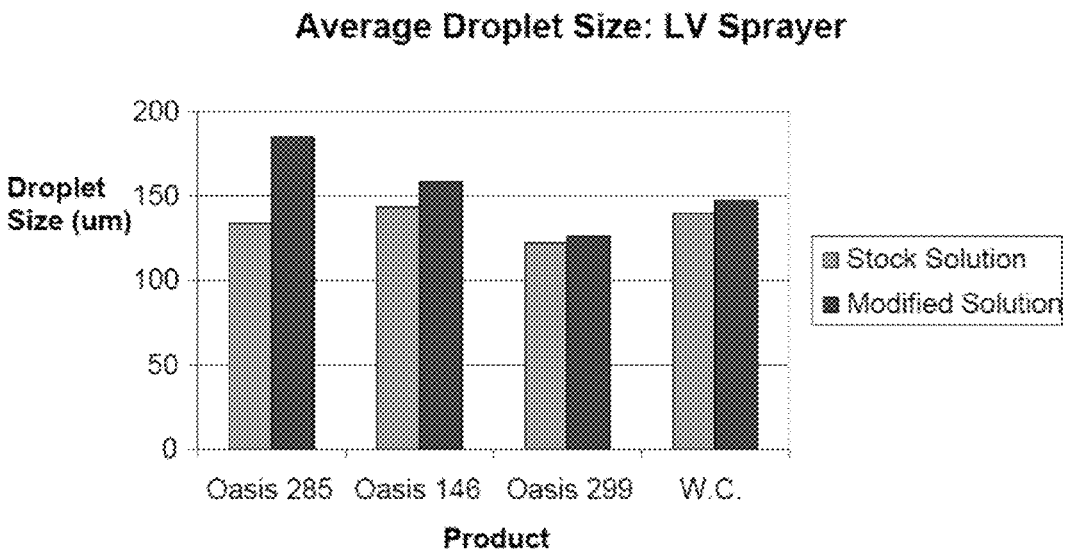
FIG. 3 illustrates average droplet size for stock ready to use sprayable solutions and ready to use sprayable solutions modified with polyethylene oxide when applied with a low viscosity trigger sprayer.

FIG. 3 illustrates the average droplet size for each stock and modified solution when applied with a low velocity trigger sprayer available from Calmar. The addition of 0.003% polyethylene oxide increased the droplet size on average by 157.8% for all products tested.

Example 5

Stability Test

Samples 66-88 and Comparative Samples F, G and H

The purpose of this experiment was to observe the degradation rate of high molecular weight PEO efficacy via a drop in shear viscosity over time using a Brookfield Viscometer. Samples 66-88 were formed by adding the stability additive specified in Table 13 to the concentrate highly acidic cleaner A of Table B above. Additional Polyox WSR 301 was also added so that the resulting formulations contained 0.2% Polyox WSR 301. The concentration of Polyox WSR 301 was chosen so that the resulting formulation had a viscosity relatively greater than water. The high Polyox WSR 301 concentration was only chosen in order to allow observance of the degradation rate and produced an undesirably thick solution.

TABLE 13

| Sample | Irganox 5057 | Irganox 1135 | Dissolvine GL-47 | Propylene glycol | Glycerine | Vitamin E acetate |
|---|---|---|---|---|---|---|
| 66 | 2000 ppm | 0 | 0 | 0 | 0 | 0 |
| 67 | 1000 ppm | 0 | 0 | 0 | 0 | 0 |
| 68 | 500 ppm | 0 | 0 | 0 | 0 | 0 |
| 69 | 100 ppm | 0 | 0 | 0 | 0 | 0 |
| 70 | 0 | 2000 ppm | 0 | 0 | 0 | 0 |
| 71 | 0 | 1000 ppm | 0 | 0 | 0 | 0 |
| 72 | 0 | 500 ppm | 0 | 0 | 0 | 0 |
| 73 | 0 | 100 ppm | 0 | 0 | 0 | 0 |
| 74 | 0 | 0 | 50,000 ppm | 0 | 0 | 0 |
| 75 | 0 | 0 | 20,000 ppm | 0 | 0 | 0 |
| 76 | 0 | 0 | 5000 ppm | 0 | 0 | 0 |
| 77 | 0 | 0 | 1000 ppm | 0 | 0 | 0 |
| 78 | 0 | 0 | 0 | 50,000 ppm | 0 | 0 |
| 79 | 0 | 0 | 0 | 10,000 ppm | 0 | 0 |
| 80 | 0 | 0 | 0 | 5000 ppm | 0 | 0 |
| 81 | 0 | 0 | 0 | 1000 ppm | 0 | 0 |
| 82 | 0 | 0 | 0 | 0 | 50,000 ppm | 0 |
| 83 | 0 | 0 | 0 | 0 | 10,000 ppm | 0 |
| 84 | 0 | 0 | 0 | 0 | 5000 ppm | 0 |
| 85 | 0 | 0 | 0 | 0 | 1000 ppm | 0 |
| 86 | 0 | 0 | 0 | 0 | 0 | 5000 ppm |
| 87 | 0 | 0 | 0 | 0 | 0 | 500 ppm |
| 88 | 0 | 0 | 0 | 0 | 0 | 100 ppm |

The viscosities of the concentrate solutions were measured with a DV-II+ Viscometer available from Brookfield before storage and after storage for 5 days, 10 days, 18 days, 24 days and 32 days at 120° F. and at room temperature. To measure the viscosity, the samples were allowed to stabilize at room temperature (about 72° F.) and then tested with the Brookfield Viscometer using spindle RV-2 at 2 RPM and 5 minutes settling time between samples. The after storage viscosity to original viscosity ratio was calculated for each sample ((after storage viscosity/original viscosity)*100%) and are presented in Table 14.

TABLE 14

| Sample | Day 5/ Day 1 | Day 10/Day 1 | Day 18/Day 1 | Day 24/ Day 1 | Day 32/ Day 1 |
|---|---|---|---|---|---|
| 66 | 51.15 | 39.66 | 33.91 | 29.60 | 29.31 |
| 67 | 56.51 | 33.80 | 32.69 | 27.91 | 28.32 |
| 68 | 56.52 | 45.15 | 39.80 | 34.11 | 33.19 |
| 69 | 23.28 | 59.45 | 40.21 | 43.30 | 37.20 |
| 70 | 67.95 | 56.09 | 53.53 | 64.10 | 63.62 |
| 71 | 77.27 | 78.57 | 56.17 | 49.03 | 49.35 |
| 72 | 71.91 | 51.17 | 51.17 | 42.56 | 42.89 |
| 73 | 60.55 | 58.82 | 49.48 | 43.34 | 42.99 |
| 74 | 88.21 | 72.01 | 71.65 | 61.93 | 62.29 |
| 75 | 82.31 | 76.87 | 54.08 | 49.32 | 49.66 |
| 76 | 67.69 | 54.42 | 55.44 | 49.66 | 49.32 |
| 77 | 53.57 | 47.08 | 45.45 | 46.75 | 46.43 |
| 78 | 48.22 | 40.60 | 42.51 | 39.81 | 39.49 |
| 79 | 53.77 | 43.15 | 42.98 | 41.35 | 41.70 |
| 80 | 55.86 | 45.86 | 41.64 | 43.28 | 42.59 |
| 81 | 56.83 | 54.32 | 37.77 | 37.41 | 38.94 |
| 82 | 36.15 | 46.94 | 34.69 | 40.23 | 38.85 |
| 83 | 49.49 | 48.15 | 39.73 | 39.73 | 40.66 |
| 84 | 54.73 | 45.82 | 44.36 | 42.91 | 42.55 |
| 85 | 51.90 | 43.10 | 47.59 | 41.03 | 40.69 |
| 86 | 57.00 | 52.67 | 37.33 | 42.75 | 42.42 |
| 87 | 61.22 | 48.70 | 45.91 | 37.65 | 38.00 |
| 88 | 55.67 | 54.61 | 56.03 | 45.83 | 46.19 |
| Comp. F | 94.24 | 88.14 | 72.88 | 74.92 | 79.32 |
| Comp. G | 51.44 | 31.12 | 24.82 | 19.78 | 16.91 |
| Comp. H | 79.65 | 76.49 | 71.93 | 64.56 | 59.65 |

The results were compared to Comparative Samples F, G and H. Comparative Sample F was highly acidic cleaner A containing 0.2% by weight Polyox and stored at room temperature for four weeks. Comparative Sample G was highly acidic cleaner A containing 0.2% by weight Polyox and stored at 120° F. for four weeks. Comparative Sample H was highly acidic cleaner A containing 0.2% by weight Polyox and stored in the dark at room temperature for four weeks. After storage for 32 days, Samples 70 and 74 and Comparative Samples F and H had a viscosity ratio greater than 50%. A reduction in viscosity (i.e., a low viscosity ratio) may indicate degradation of Polyox.

Samples 89-94 and Comparative Sample I

The polymer degradation rate for compositions including a combination of antioxidants and chelants were also investigated. The concentrate samples included 0.044% by weight Polyox WSR 301 and the additive specified below in the concentrate highly acidic acid cleaner A.

TABLE 15

| Sample | Dissolvine GL-47, wt % | Irganox 1135, wt % | Tinogard NOA, wt % |
|---|---|---|---|
| 89 | 5 | 0 | 0 |
| 90 | 0 | 0.4 | 0 |
| 91 | 0 | 0 | 0.4 |
| 92 | 2.5 | 0.2 | 0 |
| 93 | 2.5 | 0 | 0.2 |
| 94 | 0 | 0.2 | 0.2 |
| Comp. I | 0 | 0 | 0 |

The concentrate samples were formed by mixing the Polyox WSR 301 and the stability additive with the Glucopon of the highly acidic acid cleaner A for about 10 minutes. The Polyox, stability additive, Glucopon mixture was then mixed with the remaining ingredients of highly acidic acid cleaner A for 10 minutes. The samples were allowed to settle overnight at room temperature and then were stored at 120° F. After a storage period, the samples were removed from the oven, returned to room temperature. A use solution with 0.004% by weight Polyox WSR 301 was created by diluting a portion of the sample with water. The use solutions were sprayed with stock trigger sprayers and the spray patterns were qualitatively observed. The spray patterns were graded based on observed misting or aerosol in the air and the percentage of cleaner contacting the surface of the substrate, with the better spray patterns having less observed misting and a higher amount of cleaner making contact with the substrate.

After five days of storage at 120° F., Samples 89-94 had better spray patterns than Comparative Sample I, and Samples 92 and 93 had the best spray pattern. Similarly, after fourteen days of storage at 120° F., Samples 89-94 had better spray patterns than Comparative Sample I, and Samples 92 and 93 produced the most preferred spray patterns.

Example 5

Polyacrylate Test

Samples 95-98

The purpose of this experiment was to evaluate the effectiveness of polyacrylate as an anti-mist component. Aquatreat AR-7-H was added to water according to Table 16 to form use solutions which were sprayed using a stock trigger sprayer.

TABLE 16

| | Sample 95 | Sample 96 | Sample 97 | Sample 98 |
|---|---|---|---|---|
| Aquatreat AR-7-H, 20% active, wt % | 2.5% | 0.5% | 0.25% | 0.05% |
| Water, wt % | 97.5% | 99.5% | 99.75% | 99.95% |
| % active polyacrylate | 0.5% | 0.1% | 0.05% | 0.01% |

All use solutions had a viscosity comparable to that of water (based on visual observation) and homogenized in about 1 minute or less to form a clear, colorless solution. Reduced misting was visually observed for Sample 95.

Sample 99

Sample 99 was a concentrate composition formed by mixing 25 grams Aquatreat AR-7-H with 75 grams water to form a 4% active polyacrylate concentrate. Sample 99 had a viscosity comparable to that of water (based on visual observation), and was a clear, colorless solution.

Example 6

Distance Test

Samples 100-102 and Comparative Sample J

Tests were conducted to investigate the effect of Polyox on the average flight distance of a use solution when dispensed with a stock trigger sprayer using Diazo paper by Dietzgen, which turns blue when exposed to ammonia.

First, water and Polyox concentrations were formed according to Table 17 below. Ammonium Hydroxide in an amount of 2.5% by weight was also added to each Sample. The solutions were added to stock trigger sprayers.

Next, Diazo paper was arranged along a horizontal surface and the stock trigger sprayer was placed at one end of the paper so that when dispensed the horizontal flight distance of the Sample was parallel with the length of the paper. The solution was dispensed by squeezing the trigger sprayer. Because the Samples included ammonia, the paper turned blue when it was contacted by the Sample and the horizontal flight distance of each droplet was visible. The droplet having the further horizontal flight distance was determined and measured. The test was repeated two additional times and the furthest horizontal fight distance of each trial was averaged. The results are presented in Table 17.

TABLE 17

| Sample | Polyox WSR 301 (ppm) | Flight distance (inch) | % increase vs. Comp. J |
|---|---|---|---|
| 100 | 20 | 78.3 | 17.39 |
| 101 | 40 | 88.3 | 32.38 |
| 102 | 60 | 112.4 | 68.5 |
| Comp. J | 0 | 66.7 | n/a |

As shown in Table 17, Polyox increased the flight distance of the Samples compared to Comparative Sample J, which did not include Polyox.

Various modifications and additions can be made to the exemplary embodiments discussed without departing from the scope of the present invention. For example, while the embodiments described above refer to particular features, the scope of this invention also includes embodiments having different combinations of features and embodiments that do not include all of the above described features.

The following is claimed:

1. A non-Newtonian aqueous concentrate composition comprising:

at least one acid;

at least one surfactant; and at least one anti-mist component comprising polyethylene oxide having a molecular weight of 3,000,000 to 7,000,000 daltons, wherein the composition is a non-Newtonian having a viscosity of less than about 40 centipoise.

2. The non-Newtonian aqueous concentrate composition of claim 1, further comprising at least one stability component selected from the group consisting of antioxidants, chelants, and solvents.

3. The non-Newtonian aqueous concentrate composition of claim 2, wherein the solvent is selected from the group consisting of propylene glycol and glycerine.

4. The non-Newtonian aqueous concentrate composition of claim 1, further comprising at least two stability components selected from the group consisting of antioxidants, chelants, and solvents.

5. The non-Newtonian aqueous concentrate composition of claim 1, wherein the acid includes at least one of phosphoric acid, citric acid, lactic acid, or methane sulfonic acid.

6. The non-Newtonian aqueous concentrate composition of claim 1, wherein the concentrate composition has a pH of 4.5 or lower.

7. The non-Newtonian aqueous concentrate composition of claim 1, wherein:

the at least one acid constitutes from about 7% to about 35% by weight of the aqueous concentrate composition, the at least one surfactantconstitutes from about 1.5% to about 12% by weight of the aqueous concentrate composition, and the anti-mist component constitutes from about 0.01% to about 0.3% by weight of the aqueous concentrate composition; and the aqueous concentrate composition constitutes from about 45% to about 75% water by weight.

8. A non-Newtonian aqueous concentrate composition, comprising:

water, wherein the water constitutes from about 45% and about 75% by weight of the aqueous concentrate composition, at least one fatty acid selected from the group consisting of hexanoic acid, butyric acid, octanoic acid, heptanoic acid, nonanoic acid, decanoic acid, undecanoic acid, and dodecanoic acid, wherein the at least one fatty acid constitutes from about 7% to about 35% by weight of the aqueous concentrate composition, at least one surfactant, wherein the at least one surfactant constitutes from about 1.5% to about 12% by weight of the aqueous concentrate composition, and an anti-mist component comprising polyacrylate, the anti-mist component comprising from about 0.5% to about 20% by weight of the aqueous concentrate composition;

wherein the composition is a non-Newtonian having a viscosity of less than about 40 centipoise.

9. The non-Newtonian aqueous concentrate composition of claim 7, further comprising between about 0.01 and about 10.0% by weight propylene glycol.

10. The non-Newtonian aqueous concentrate composition of claim 7, further comprising between about 0.05% and 10% by weight of at least one stability component selected from the group consisting of antioxidants, chelants, and solvents.

11. The non-Newtonian aqueous concentrate composition of claim 10, wherein the stability component is dicarboxymethyl glutamic acid tetrasodium salt (GLDA).

12. The non-Newtonian aqueous concentrate composition of claim 1, wherein:

the at least one acid constitutes from about 10% to about 75% by weight of the aqueous concentrate composition, the at least one surfactant constitutes between about 1.3% and about 12% by weight of the aqueous concentrate composition, and the anti-mist component constitutes between about 0.01% and about 0.3% by weight of the aqueous concentrate composition; and the aqueous concentrate composition constitutes from about 25% to about 50% water by weight.

13. A non-Newtonian aqueous concentrate composition, comprising:

water, wherein water constitutes between about 25% and about 50% by weight of the aqueous concentrate composition, at least one fatty acid selected from the group consisting of hexanoic acid, butyric acid, octanoic acid, heptanoic acid, nonanoic acid, decanoic acid, undecanoic acid, and dodecanoic acid, wherein the at least one fatty acid constitutes between about 10% and about 75% by weight of the aqueous concentrate composition, at least one surfactant, wherein the at least one surfactant constitutes between about 1.3% and about 12% by weight of the aqueous concentrate composition, and an anti-mist component comprising polyacrylate, the anti-mist component constituting from about 0.5% to about 20% by weight of the aqueous concentrate composition;

wherein the composition is a non-Newtonian having a viscosity of less than about 40 centipoise.

14. A non-Newtonian aqueous concentrate composition comprising at least one fatty acid selected from the group consisting of: hexanoic acid, butyric acid, octanoic acid, heptanoic acid, nonanoic acid, decanoic acid, undecanoic acid, and dodecanoic acid, wherein the at least one fatty acid constitutes from about 0.5% to about 15% by weight of the aqueous concentrate composition, at least one surfactant, wherein the at least one surfactant constitutes from about 0.1% to about 30% by weight of the aqueous concentrate composition, and an anti-mist component is-selected from the group consisting of polyethylene oxide, polyacrylamide and combinations thereof, wherein the anti-mist component constitutes from about 0.01% to about 0.3% by weight of the aqueous concentrate composition;

wherein the composition is a non-Newtonian having a viscosity of less than about 40 centipoise.

15. A non-Newtonian aqueous concentrate composition comprising:

at least one fatty acid selected from the group consisting of: hexanoic acid, butyric acid, octanoic acid, heptanoic acid, nonanoic acid, decanoic acid, undecanoic acid, and dodecanoic acid, wherein the at least one fatty acid constitutes from about 0.5% to about 15% by weight of the aqueous concentrate composition, at least one surfactant, wherein the at least one surfactant constitutes from about 0.1% to about 30% by weight of the aqueous concentrate composition, and an anti-mist component comprising polyacrylate, wherein the anti-mist component constitutes from about 0.5% to about 20% by weight of the aqueous concentrate composition;

wherein the composition is a non-Newtonian having a viscosity of less than about 40 centipoise.

16. The non-Newtonian aqueous concentrate composition of claim 1, wherein the composition is a sprayable composition by utilizing a spray bottle device comprising a spray head and a container attached to the spray head.

17. The non-Newtonian aqueous concentrate composition of claim 1, wherein the composition is a sprayable composition by utilizing a low velocity sprayer.

18. A method of forming a use solution, the method comprising:

mixing water with an aqueous concentrate composition according to claim 1 to create the use solution, wherein the aqueous concentrate composition is mixed with sufficient water to form a use solution having between about 0.002% and about 0.006% by weight anti-mist component.

19. The method of claim 18, wherein the aqueous concentrate composition further comprising at least one stability component selected from the group consisting of antioxidants, chelants, and solvents.

20. The method of claim 18, wherein the aqueous concentrate composition further includes between about 0.01% and about 10.0% by weight propylene glycol.

21. The method of claim 18, wherein the aqueous concentrate composition includes at least one acid and the use solution has a pH of about 4.5 or less.

22. The method of claim 21, wherein the acid includes a fatty acid selected from the group consisting of: hexanoic acid, butyric acid, octanoic acid, heptanoic acid, nonanoic acid, decanoic acid, undecanoic acid, and dodecanoic acid.

23. A method of forming a use solution, the method comprising:

mixing water with an non-Newtonian aqueous concentrate composition to create the use solution, the aqueous concentrate composition comprising:

at least one surfactant, wherein the surfactant includes a quaternary ammonium compound; and at least one anti-mist component selected from the group consisting of polyethylene oxide and polyacrylamide;

wherein the aqueous concentrate composition is mixed with sufficient water to form a use solution having between about 0.002% and about 0.006% by weight anti-mist component.

24. The method of claim 18, wherein the aqueous concentrate composition includes a dispersant.

25. The method of claim 18, wherein the surfactant includes at least one nonionic surfactant and at least one anionic surfactant.

26. A method of forming a use solution, the method comprising:

mixing water with an concentrate composition to create the use solution, the concentrate composition comprising:

at least one surfactant comprising a quaternary ammonium compound; and a polyacrylate;

wherein the aqueous concentrate composition is mixed with sufficient water to form a use solution having between about 0.2% and about 5% by weight polyacrylate.

27. The method of claim 26, wherein the aqueous concentrate composition further comprising at least one stability component selected from the group consisting of antioxidants, chelants, and solvents.

28. The method of claim 26, wherein the aqueous concentrate composition further includes between about 0.01% and about 10.0% by weight propylene glycol.

29. The method of claim 26, wherein the aqueous concentrate composition includes at least one acid and the use solution has a pH of about 4.5 or less.

30. The method of claim 26, wherein the acid includes a fatty acid selected from the group consisting of: hexanoic acid, butyric acid, octanoic acid, heptanoic acid, nonanoic acid, decanoic acid, undecanoic acid, and dodecanoic acid.

31. The method of claim 26, wherein the surfactant includes at least one nonionic surfactant and at least one anionic surfactant.

32. The non-Newtonian aqueous concentrate composition of claim 1, wherein the anti-mist component further comprises polyacrylamide.

33. The non-Newtonian aqueous concentrate composition of claim 7, wherein the anti-mist component further comprises polyacrylamide.

34. The non-Newtonian aqueous concentrate composition of claim 12, wherein the anti-mist component further comprises polyacrylamide.

35. A method of forming a use solution, the method comprising:

mixing water with an aqueous concentrate composition to create the use solution, the aqueous concentrate composition comprising:

a fatty acid selected from the group consisting of hexanoic acid, butyric acid, octanoic acid, heptanoic acid, nonanoic acid, decanoic acid, undecanoic acid, and dodecanoic acid;

at least one surfactant; and a polyacrylate;

wherein the aqueous concentrate composition is mixed with sufficient water to form a use solution having between about 0.2% and about 5% by weight polyacrylate.

36. The method of claim 35, wherein the aqueous concentrate composition further comprising at least one stability component selected from the group consisting of antioxidants, chelants, and solvents.

37. The method of claim 35, wherein the aqueous concentrate composition further includes between about 0.01% and about 10.0% by weight propylene glycol.

38. The method of claim 35, wherein the aqueous concentrate composition includes at least one acid and the use solution has a pH of about 4.5 or less.

* * * * *